US009416636B2

(12) United States Patent
Myhre et al.

(10) Patent No.: US 9,416,636 B2
(45) Date of Patent: Aug. 16, 2016

(54) HYDRAULIC CUTTING TOOL, SYSTEM AND METHOD FOR CONTROLLED HYDRAULIC CUTTING THROUGH A PIPE WALL IN A WELL

(71) Applicant: Well Technology AS, Tananger (NO)

(72) Inventors: Morten Myhre, Tananger (NO); Arne Gunnar Larsen, Sandnes (NO); Roy Inge Jensen, Stavanger (NO); Patrick Andersen, Hafrsfjord (NO); Erlend Engelsgjerd, Tananger (NO); Markus Iuell, Tananger (NO); Arnt Olav Dahl, Randaberg (NO); Nils Rune Haga, Royneberg (NO); Arnold Ostvold, Stavanger (NO)

(73) Assignee: Well Technology AS, Tananger (NO)

( * ) Notice: Subject to any disclaimer, the term of this patent is extended or adjusted under 35 U.S.C. 154(b) by 275 days.

(21) Appl. No.: 14/246,913

(22) Filed: Apr. 7, 2014

(65) Prior Publication Data

US 2015/0233218 A1 Aug. 20, 2015

(30) Foreign Application Priority Data

Feb. 18, 2014 (NO) ..... 20140209

(51) Int. Cl.
*E21B 29/06* (2006.01)
*E21B 43/114* (2006.01)
*E21B 33/13* (2006.01)

(52) U.S. Cl.
CPC ..... *E21B 43/114* (2013.01); *E21B 29/06* (2013.01); *E21B 33/13* (2013.01)

(58) Field of Classification Search
CPC ..... E21B 29/06; E21B 41/0078; E21B 7/18; E21B 73/114; B24C 5/02; B26F 1/26
See application file for complete search history.

(56) References Cited

U.S. PATENT DOCUMENTS

| | | | | |
|---|---|---|---|---|
| 5,320,174 | A * | 6/1994 | Terrell | E21B 43/114 149/108.2 |
| 5,381,631 | A | 1/1995 | Raghavan et al. | |
| 5,765,756 | A | 6/1998 | Jordan et al. | |
| 6,155,343 | A | 12/2000 | Nazzal et al. | |
| 6,564,868 | B1 | 5/2003 | Ferguson et al. | |
| 2004/0089450 | A1 | 5/2004 | Slade et al. | |
| 2012/0279706 | A1 | 11/2012 | Solversen et al. | |
| 2012/0305251 | A1 | 12/2012 | Solversen et al. | |

FOREIGN PATENT DOCUMENTS

| | | |
|---|---|---|
| GB | 2288350 | 10/1995 |
| NO | 20111641 | 11/2011 |

(Continued)

*Primary Examiner* — Cathleen Hutchins
(74) *Attorney, Agent, or Firm* — Andrus Intellectual Property Law, LLP

(57) ABSTRACT

A hydraulic cutting tool, a system, and a method are for hydraulic cutting through a pipe wall of a pipe body. For this purpose, the cutting tool is provided with at least one cutting section comprising at least one fluid discharge body. Each such fluid discharge body comprises at least two outwardly directed discharge openings having non-parallel discharge directions directed at a common intersection point located outside the fluid discharge body. The cutting is carried out by means of an abrasive fluid being supplied, via a flow-through pipe string, to the at least one fluid discharge body from a remote location. Thereby, abrasive cutting jets will discharge at high velocity from the fluid discharge body so as to meet and disperse in the intersection point, thus weakening the further cutting ability of the cutting jets.

54 Claims, 15 Drawing Sheets

(56) References Cited

FOREIGN PATENT DOCUMENTS

| | | |
|---|---|---|
| NO | 20120277 | 3/2012 |
| WO | 0125594 | 4/2001 |
| WO | 02081861 | 10/2002 |
| WO | 2012096580 | 7/2012 |
| WO | 2013133719 | 9/2013 |

* cited by examiner

HYDRAULIC CUTTING TOOL, SYSTEM AND METHOD FOR CONTROLLED HYDRAULIC CUTTING THROUGH A PIPE WALL IN A WELL

CROSS-REFERENCE TO RELATED APPLICATION

The present utility patent application claims the benefit of and priority to Norwegian Patent Application Serial No. 20140209, filed Feb. 18, 2014, which is incorporated herein by reference.

FIELD OF THE INVENTION

The present invention concerns a hydraulic cutting tool for hydraulic cutting through a pipe wall of a pipe body, and from internally in the pipe body, thereby forming at least one hole through the pipe wall.

The invention also concerns a system and a method for controlled hydraulic cutting through a first pipe body in a well, thereby forming at least one hole through said pipe wall, and without cutting through a pipe wall of a second pipe body located outside and around the first pipe body in the well.

Said well may be comprised of any type of subterranean well, for example a petroleum well, injection well, exploration well, geothermal well or water well. Such a well may also be a vertical well or a deviation well. Moreover, the well may be located onshore or offshore.

Furthermore, said pipe bodies typically may be comprised of casings, liners, production tubings, injection tubings or similar pipe bodies disposed in a subterranean well. Typically, such a well will be provided with a tubular constellation of several different diameter sizes of more or less concentrically disposed pipe bodies (or pipe strings) extending individually and successively, and with diminishing tubular cross section, down to increasingly larger depths in the well.

The present invention may also be suitable, as an introductory measure, in context of temporary or permanent plugging of one or more longitudinal sections in such a subterranean well.

BACKGROUND OF THE INVENTION

In context of many downhole operations in a well, it is necessary to form holes through a pipe wall of one or more pipe bodies (or pipe strings) being more or less concentrically disposed in the well. As such, it may involve making holes through the pipe wall of casings, liners, production tubings or similar pipe bodies. This is oftentimes referred to as perforation of the pipe body.

For such perforation purposes, it is customary to use a perforation tool provided with explosive charges and being lowered into the particular pipe body from the surface of the well. Upon lowering such a perforation tool into the pipe body, the tool is typically mounted on a lower end of a connection line, which may be comprised of an electric cable, a coiled tubing string or a drill pipe string. Normally, such a perforation tool does not have to be anchored and centralized in the pipe string prior to activating detonation of the charges.

Further, such a perforation tool will normally be provided with so-called shaped charges, which typically are assembled and distributed according to a specific pattern on the perforation tool, the charges of which form, upon detonation, substantially circular holes through the pipe wall of the surrounding pipe body. Yet further, the explosive charges of the perforation tool may be activated and detonated via an electric signal or a pressure increase communicated to the tool from the surface of the well. Such perforation equipment constitutes prior art per se, hence is not discussed in further detail herein.

When using such explosive charges for perforation purposes in a well, it may prove difficult to control, with relatively good accuracy, the radial perforation depth outwards from the perforation tool. However, for some downhole operations, such as perforation of one or more pipe bodies for production or injection purposes, such a control of the perforation depth is of relatively little importance given that a greatest possible perforation depth oftentimes is desirable in such situations in order to achieve good fluid communication with the rocks surrounding the well.

On the other hand, a relatively accurate control of the perforation depth may be of great importance in a well where two or more pipe bodies (or pipe strings) are disposed more or less concentrically relative to each other, and where it is desirable only to form perforations (holes) through the pipe wall of the innermost pipe body in such a tubular constellation. Such a need may exist if desirable to clean and/or introduce, via such perforations, a treatment fluid, for example a fluidized plugging material, into an annulus located immediately outside the innermost pipe body, i.e. between the innermost pipe body and a next pipe body disposed more or less concentrically around the innermost pipe body. Methods for such perforation, cleaning as and plugging are described in WO 2012/096580 A1 and in WO 2013/133719 A1.

Given that perforation by means of explosive charges provides relatively poor control of said radial perforation depth, a need therefore exists in the industry for an alternative technical solution that is simple, operationally reliable and cost effective, and which renders possible to control said perforation depth in the radial direction outwards from an associated cutting tool when disposed in a pipe body in a well.

More specifically, a need exists for such an alternative technical solution rendering possible to make holes (perforations) only through the pipe wall of the innermost pipe body, and without perforating or significantly damaging the pipe wall of a surrounding, second pipe body in the well.

PRIOR ART AND DISADVANTAGES THEREOF

The use of hydraulic cutting tools for hydraulic cutting through a pipe wall of one or more pipe bodies constitute prior art per se. Such known cutting tools are used in a variety of technical contexts, for example for making profiled cuts through metal plates, but also for cutting through one or more pipe bodies, for example casings, in a well. Various technical solutions based on such hydraulic cutting are discussed in a number of publications.

In context of such hydraulic cutting, a pressurized abrasive fluid is normally conducted into the hydraulic cutting tool and further through one or more discharge openings in the cutting tool. Typically, such discharge openings are structured as nozzles. Alternatively, the discharge openings may be provided with releasable nozzle inserts. In each such discharge opening/nozzle, the abrasive fluid is converted into a concentrated abrasive cutting jet discharging at high velocity and cutting through the object to be penetrated, for example through the pipe wall of one or more pipe bodies. This is generally referred to as abrasive cutting.

The abrasive fluid may be comprised of a suitable liquid, for example water, which possibly is admixed with a suitable abrasive agent, for example natural or synthetic solid particles of a wear-resistant material, so-called abrasives. Such a wear-resistant material may therefore be comprised of particles of a suitable material, such as silica, ceramic, garnet, glass, iron, alumina, silicon carbide or other suitable materials. For example, such particles may be of sand-size.

In context of cutting one or more pipe bodies in a well, the abrasive fluid may be conducted down to the cutting tool in the well via a flow-through connection line extending from the surface of the well. Such a line may be comprised of a pipe string of, for example, drill pipes or coiled tubing, or of a flexible hose of a suitable type. In this context, a pump means is typically used to pump the abrasive fluid down into the well from the surface of the well.

As an alternative, the cutting tool may be provided with, or be associated with, a separate receptacle containing the abrasive fluid and being connected to a suitable driving means, for example a propellant gas or a pump means, for driving the fluid onto and through the discharge openings in the cutting tool.

Hereinafter, some patent publications concerning hydraulic cutting in wells and being considered relevant to the present invention are mentioned. When considered individually, these patent publications disclose one or more features of the present invention, but none of these patent publications disclose, when viewed in isolation, the combination of features disclosed in the present invention, the combination of which essentially concerns controlled hydraulic cutting through a pipe wall of a pipe body.

US 2004/0089450 A1 appears to represent the closest prior art with respect to the present invention. This publication concerns an apparatus and a method for abrasive cutting through a structural element, for example through a pipe wall of a pipe body in a well. The apparatus is self-sufficient in the sense that it comprises all necessary means to carry out such a cutting operation in a well, and from internally in a pipe body in the well. As such, the apparatus is not connected to a flow-through connection line extending from the surface of the well for supply of an abrasive fluid for said cutting purpose.

The apparatus according to US 2004/0089450 A1 comprises a gas generator containing a solid fuel which, when activated, generates a propellant gas being conducted into a pressure vessel containing an abrasive fluid. The propellant gas forces the abrasive fluid out of the pressure vessel and onwards through nozzles in a separate nozzle assembly disposed, when in its position of use in the pipe body, vis-à-vis said pipe wall. Abrasive cutting jets discharging from the nozzles and individually being concentrated and continuous may thus cut through the pipe wall of the pipe body. Said nozzle assembly may also be structured so as to be rotatable, whereby the assembly may be rotated around the longitudinal axis of the apparatus. By so doing, it 30*o* is possible to carry out a complete peripheral cut through the pipe wall of the pipe body, and in such a manner that the pipe body is completely severed. This may be useful for allowing an upper "free" portion of the pipe body to be liberated from a lower portion of the pipe body being "stuck" in the well, which is the primary purpose of the apparatus.

According to one particular embodiment of US 2004/0089450 A1, the apparatus may also be arranged so as to have a limited radial cutting range (i.e. effective cutting range), thereby limiting any damage to, for example, a second pipe body located outside and enclosing an innermost pipe body in the well. Such a limited radial cutting range may be achieved by virtue of directing several abrasive cutting jets towards a specific location (intersection point) outside the apparatus, and preferably in proximity of an outer diameter of the innermost pipe body. Before the cutting jets intersect and collide at the specific location, each cutting jet will be concentrated and continuous and, hence, will have a concentrated kinetic energy. This provides the individual cutting jet with a high cutting ability and is useful for cutting effectively through the pipe wall of the innermost pipe body. Contrary, when the cutting jets intersect and collide at said location outside the apparatus, the cutting jets will attempt to disperse in many directions. By so doing, the cutting jets also lose a significant proportion of their concentrated kinetic energy and cutting ability in the radial direction relative to the apparatus. In this context, the kinetic energy in oppositely directed and "colliding" components of such intersecting cutting jets will be converted into heat energy and into turbulence and/or multidirectional flow. This implies that the remaining and significantly reduced proportion of the kinetic energy is carried mainly by radial, outwardly directed components of such intersecting cutting jets. The kinetic energy and cutting ability available in the cutting jets for further cutting in the radial direction beyond said specific location (intersection point) will thus be significantly reduced relative to the kinetic energy and cutting ability available in the cutting jets before intersecting at said location. By so doing, the radial cutting ability of the cutting jets is also weakened significantly beyond said location (intersection point), thereby limiting the effective cutting range of the apparatus in the radial direction.

Insofar as the apparatus according to US 2004/0089450 A1 is self-sufficient and comprises, among other things, said gas generator containing a solid fuel, and also a pressure vessel containing the abrasive fluid, the apparatus constitutes a relatively complicated structure. In order to ignite the fuel, the apparatus must also be provided with an igniting device being remotely controlled by means of radio frequency equipment, for example. Moreover, the apparatus may comprise a rotary device and rotary connections for allowing said nozzle assembly to rotate about the longitudinal axis of the apparatus during cutting. As such, the apparatus comprises many components and equipment that possibly may fail during use so as to reduce the operational reliability of the apparatus. All of this implies that the apparatus will be encumbered with relatively high costs for the production, operation and maintenance of the apparatus. In addition, the apparatus is only applicable for dedicated and short cutting operations down in a well, which is related to the apparatus only carrying along certain quantities of fuel and abrasive fluid. Upon having consumed the fuel and the abrasive fluid, the apparatus must be pulled out of the well for recharging. All of this implies that the apparatus according to US 2004/0089450 A1 is not of a simple and operationally reliable structure, and also that the apparatus is not suitable for comprehensive and controlled hydraulic cutting through a pipe body in a well. As mentioned, the primary purpose of the apparatus is to be able to sever and liberate an upper "free" portion of the pipe body from a lower portion of the pipe body being "stuck" in the well.

Further, U.S. Pat. No. 6,155,343 A concerns a downhole cutting tool and system for hydraulic cutting through a pipe wall of a pipe body in a well. The cutting tool is partially self-sufficient and comprises, among other things, a cutting unit and a power unit. The cutting unit is provided with a nozzle discharging, when in use, a jet of a cutting fluid towards the pipe body. The cutting fluid may either be supplied from the surface of the well via a supply line, or the cutting fluid may be comprised of a fluid taken directly into the cutting tool from the well. It is also stated that the cutting fluid may be comprised of an abrasive fluid. The special feature of this cutting tool is that it comprises said power unit, the purpose of which is to increase the pressure in the cutting fluid in stages before discharging the fluid from the nozzle in the cutting device, and then possibly as a pulsed cutting jet. The cutting tool also comprises an orienting section containing a device for orienting the nozzle into the correct position and direction in the well, whereby precision cutting may be carried out through the pipe wall. Moreover, the cutting unit and its nozzle may be structured for rotation around the longitudinal axis of the cutting tool, whereby a complete or partial peripheral cut may be carried out through the pipe wall. The cutting tool may also comprise external stabilizers for ensuring a minimum of radial movement of the tool during cutting of the pipe body. Preferably, the cutting operation is remotely controlled via wireless telemetry signals being communicated between a control unit on the surface and a control section in the cutting tool.

The cutting tool according to U.S. Pat. No. 6,155,343 A also constitute a relatively complicated structure having many components, including electronic components, that possibly may fail during use so as to reduce the operational reliability of the cutting tool. This implies that the cutting tool will be encumbered with relatively high costs for the production, operation and maintenance of the cutting tool.

Furthermore, U.S. Pat. No. 6,155,343 A mentions nothing about intersecting cutting jets, or about limiting the radial cutting range and cutting depth of the cutting jets.

Yet further, U.S. Pat. No. 6,564,868 B1 concerns a cutting tool and a method for hydraulic cutting through a pipe wall of a pipe body in a well. This cutting tool, however, is structured for connection to a lower end of a pipe string for remote supply of a cutting fluid, which may be comprised of an abrasive fluid. The cutting tool comprises a tubular housing having an internal flow channel connected in a flow communicating manner to at least one outwardly directed discharge opening disposed at a lower portion of the housing. Such a discharge opening possibly may be provided with a nozzle insert, whereas the housing may be provided with oppositely directed discharge openings, for example. Upon pumping said cutting fluid down into the well via said pipe string and further through the cutting tool, a cutting jet is discharged from the at least one discharge opening/nozzle insert of the tool and towards the pipe body for cutting through the pipe wall. The cutting tool may also comprise a fluid-driven motor connected in a rotable manner to the tubular housing for rotation of the housing around the longitudinal axis of the cutting tool, whereby said cutting jet is rotated around said longitudinal axis. Thereby, the cutting tool is structured in a manner allowing it to carry out complete or partial peripheral cuts, and possible perforations, through the pipe wall of the pipe body.

Unlike the above-mentioned cutting tools, the cutting tool according to U.S. Pat. No. 6,564,868 B1 is of a relatively simple structure and mode of operation.

U.S. Pat. No. 6,564,868 B1, too, does not mention anything about intersecting cutting jets, or about limiting the radial cutting range and cutting depth of the cutting jet.

U.S. Pat. No. 5,765,756 A also concerns a cutting tool and a method for hydraulic cutting through a pipe wall of a pipe body in a well. Also this cutting tool is structured for connection to a lower end of a pipe string of, for example, drill pipes or coiled tubing for remote supply of an abrasive cutting fluid. The cutting tool comprises a tubular body having at least one internal flow channel for conducting the abrasive fluid onwards to one or more nozzles being disposed in a rotable manner relative to the tool body. Thereby, the nozzle may be rotated from a passive, retracted position in the tool body to an active, outwardly directed cutting position where an abrasive cutting jet discharges from the nozzle and cuts through said pipe wall. Such a nozzle may also be structured as a movable and telescopically extendable nozzle being retracted into the tool body when in a passive position, and being extended telescopically outwards and directed at the pipe wall of the pipe body for abrasive cutting through the pipe wall when in an active cutting position. The abrasive cutting tool may be used to mill away a longitudinal portion of the pipe body, or to carry out one or more profiled cuts through the pipe wall, or to form holes (perforations) through the pipe wall.

The cutting tool according to U.S. Pat. No. 5,765,756 A constitutes a relatively complicated structure having many movable parts that possibly may fail during use so as to reduce the operational reliability of the cutting tool. This also implies that the cutting tool will be encumbered with relatively high costs for the production, operation and maintenance of the cutting tool.

U.S. Pat. No. 5,765,756 A, too, does not mention anything about intersecting cutting jets, or about limiting the radial cutting range and cutting depth of the cutting jet.

In addition, each of US 2012/0279706 A1 and US 2012/0305251 A1 (same applicant) concerns a cutting tool and a method for hydraulic cutting through a pipe wall of a pipe body in a well. Following hydraulic cutting of one or more longitudinal openings through the pipe wall, the well is closed off by filling a hardenable mass into the pipe body and further out into an external annulus via said openings in the pipe wall of the pipe body. By so doing, a plug is formed in the entire cross-section of the well. Also this cutting tool is structured for connection to a lower end of a pipe string, for example a coiled tubing string, for remote supply of a cutting fluid. The cutting tool comprises a releasable anchor and an axially movable nozzle head capable of being rotated around a longitudinal axis of the well for cutting and forming of said opening(s) through the pipe wall. Such openings possibly may be formed in a specific pattern. For said cutting purpose, the nozzle head comprises an outwardly directed cutting nozzle, and also possible cleaning nozzles for flushing in the pipe body. Having set said anchor in and against the inside of the pipe body, the cutting fluid is pumped down into the well via said pipe string and further out through the cutting nozzle in the cutting head. By so doing, a discharging cutting jet is formed and cuts through said pipe wall. Upon simultaneously manipulating the nozzle head in the axial and peripheral direction, each longitudinal opening may be awarded a specific shape, and several such openings possibly may be formed in a specific pattern.

The cutting tool according to US 2012/0279706 A1 and US 2012/0305251 A1 also constitutes a relatively complicated structure having many movable parts that possibly may fail during use so as to reduce the operational reliability of the cutting tool. This also implies that the cutting tool will be encumbered with relatively high costs for the production, operation and maintenance of the cutting tool.

Furthermore, US 2012/0279706 A1 and US 2012/0305251 A1 mention nothing about intersecting cutting jets, or about limiting the radial cutting range and cutting depth of the cutting jets.

Finally, U.S. Pat. No. 5,381,631 A and GB 2.288.350 A are mentioned, both of which concern hydraulic cutting tools structured for insertion and anchoring in a pipe body. Both cutting tools are provided with a rotatable nozzle element for abrasive cutting through the pipe wall of the pipe body, and in such a manner that the pipe body is severed completely. Further, each cutting tool comprises a rotary device and rotary connections for allowing said nozzle element to rotate about the longitudinal axis of the tool during the severing of the pipe body.

Thus, also the cutting tools according to U.S. Pat. No. 5,381,631 A and GB 2.288.350 A constitute relatively complicated structures having many movable parts that possibly may fail during use so as to reduce the operational reliability of the cutting tools. This also implies that the cutting tools will be encumbered with relatively high costs for the production, operation and maintenance of the cutting tools.

U.S. Pat. No. 5,381,631 A and GB 2.288.350 A, too, do not mention anything about intersecting cutting jets, or about limiting the radial cutting range and cutting depth of the cutting jet.

OBJECTS OF THE INVENTION

The primary object of the invention is to remedy or reduce at least one disadvantage of the prior art, or at least to provide a useful alternative to the prior art.

Another object of the invention is to provide a technical solution constituting an alternative to downhole perforation through a pipe wall of a pipe body by means of explosive charges, and from internally in the pipe body.

Further, it is an object of the invention to provide such a technical alternative that is relatively simple, operationally reliable and cost effective.

Yet further, it is an object of the invention to provide a technical solution rendering possible to carry out a controlled and relatively precise cutting through the pipe wall of said pipe body, and from internally in the pipe body.

Thus, it is an object to provide a technical solution rendering possible to control the radial cutting range and cutting depth (perforation depth) through the pipe wall of the pipe body, and from internally in the pipe body.

More specifically, it is an object to provide a technical solution rendering possible to form at least one hole through a pipe wall of a first, innermost pipe body in a well, and without cutting through or significantly damaging a pipe wall of a second pipe body located outside and around the first pipe body in the well.

Further, it is an object of the invention to provide a hydraulic cutting tool, a system, a method, and also uses of said cutting tool and system, for hydraulic cutting through such a pipe body.

GENERAL DESCRIPTION OF THE INVENTION AND OF HOW THE OBJECTS ARE ACHIEVED

The objects are achieved by virtue of features disclosed in the following description and in the subsequent claims.

According to a first aspect of the invention, a hydraulic cutting tool is provided for hydraulic cutting through a pipe wall of a pipe body, and from internally in the pipe body, wherein the cutting tool comprises a mandrel having the following combination of features:

- a first end;
- a second end structured in a manner allowing it to be connected to a flow-through pipe string for selective remote supply of an abrasive fluid;
- an internal flow channel connected in a flow communicating manner to at least said second end;
- at least one anchoring section provided each with at least one radially movable gripping element structured for selective activation and anchoring against an inside of the pipe body; and
- at least one cutting section provided each with outwardly directed discharge openings connected in a flow communicating manner to said internal flow channel for supply of said abrasive fluid, wherein each discharge opening is configured in a manner allowing it to form a discharging cutting jet of the abrasive fluid for cutting through the pipe wall.

The distinctive characteristic of the hydraulic cutting tool is that such a cutting section also comprises at least one fluid discharge body;

- wherein each such fluid discharge body comprises at least two outwardly directed discharge openings having non-parallel discharge directions directed at a common intersection point located outside the fluid discharge body; and
- wherein said outwardly directed discharge openings are connected in a flow communicating manner to the internal flow channel in the mandrel.

Thereby, abrasive cutting jets, which discharge at high velocity from said discharge openings in each fluid discharge body, are structured in a manner allowing them to cut into and through the pipe wall of the pipe body, thus forming at least one hole through the pipe wall. Thereby, said abrasive cutting jets also are structured in a manner allowing them to meet and disperse in said intersection point, thus weakening the further cutting ability of the cutting jets.

In this manner, the hydraulic cutting tool may be structured so as to have a limited radial cutting range (i.e. effective cutting range) out of the discharge openings in each fluid discharge body. By so doing, it is also possible to prevent or limit any damage to an object located outside said pipe body, and possibly at a relatively short distance from the pipe body, for example within 1-5 cm of the pipe body. For example, such an object may be comprised of a second pipe body enclosing the former (and innermost) pipe body.

Before the at least two abrasive cutting jets from each fluid discharge body intersect and collide at high velocity in said common intersection point outside the present cutting tool, each cutting jet will be concentrated and continuous and, hence, will have a concentrated and high kinetic energy. This provides each individual cutting jet with a high cutting ability and is useful for cutting effectively into the pipe wall of the pipe body so as to make a hole in the pipe wall.

Subsequently, when the cutting jets from the fluid discharge body intersect and collide at high velocity in said intersection point, the cutting jets will attempt to disperse in many directions. The largest dispersion will arise in areas where the surroundings allow the cutting jets to disperse in a relatively unimpeded fashion, for example out into a liquid-filled pipe bore or annulus in a well. If, however, the cutting jets intersect some place within said pipe wall, the cutting jets will have limited space to disperse within the pipe wall and, hence, will form turbulent and/or multi-directional flow within a relatively limited cavity in the pipe wall. The flow pattern arising after said collision of the cutting jets therefore depends on the location of the intersection point relative to the pipe wall to be penetrated. As a result of this intersection and collision, the cutting jets will lose a significant proportion of their concentrated kinetic energy and cutting ability in the radial direction outwards from the cutting tool. This has to do with oppositely directed and "colliding" components of such intersecting cutting jets, i.e. mostly axially directed components, counteracting each other and largely eliminating their oppositely directed courses of flow. The proportion of the kinetic energy carried by such oppositely directed and "colliding" components of the cutting jets is converted mainly into heat energy and into turbulent and/or multi-directional flow. When in a cavity in a pipe wall, such a turbulent and/or multi-directional flow will tend to dig laterally and circularly within the cavity, which will increase the transverse dimension/diameter of the hole being formed by the intersecting cutting jets. By so doing, the remaining and significantly reduced proportion of the kinetic energy is carried mainly by radial, outwardly directed components of such intersecting cutting jets. Therefore, the kinetic energy and cutting ability being available in the cutting jets for further cutting in the radial direction beyond said intersection point will be significantly reduced relative to the kinetic energy and cutting ability available in the cutting jets before intersecting in the intersection point. In this manner, the radial cutting ability of the cutting jets is also weakened significantly beyond the intersection point, thereby limiting the effective cutting range of the cutting tool in the radial direction.

Further, the angle between two or more non-parallel discharge directions (hence cutting jets) discharging from a fluid discharge body and meeting in the intersection point may be acute, right (perpendicular) or obtuse. The angle must necessarily be less than 180 degrees for allowing cutting into the pipe body. An acute angle implies that intersecting cutting jets have a greater radial cutting ability than that of intersecting cutting jets having an obtuse angle therebetween. The opposite is true for the axial cutting ability of intersecting cutting jets, i.e. the ability to dig laterally and circularly so as to expand the hole being formed by the intersecting cutting jets. Further, each non-parallel discharge direction (and associated cutting jet) from a fluid discharge body does not need to have the same discharge angle, as measured relative to the outside of the mandrel of the cutting tool. Depending on how the non-parallel discharge directions (and cutting jets) are oriented in the mandrel, and in relation to said pipe body, this discharge angle may have an axial, radial and/or peripheral directional component. As such, the discharge directions (and the cutting jets) may lie in a plane extending mainly in the radial direction relative to a longitudinal axis through the present hydraulic cutting tool, or in a plane extending mainly in the axial direction relative to said longitudinal axis, or in a plane having both a radial and an axial directional component relative to the longitudinal axis. This implies that the resulting hole being formed through the pipe wall of the pipe body may have a radial, axial and/or peripheral longitudinal component. The angles and directions selected in this context are determined based on the existing cutting conditions and cutting requirements, and possibly based on prior tests simulating various cutting conditions and cutting requirements.

Otherwise, the term "axial" in this application refers to the direction of said longitudinal axis through the present hydraulic cutting tool and the pipe body, thereby referring to a longitudinal axis through a potential, associated well. The term "radial" in the application refers to a direction that forms an angle, and possibly a right (perpendicular) angle, relative to said longitudinal axis. This angle, however, does not necessarily have to be right and possibly may have an axial directional component. Further, the term "peripheral" in the application refers to a direction along a circumference of the cutting tool and/or the pipe body. This peripheral direction, too, does not necessarily have to form a right angle relative to said longitudinal axis and possibly may have an axial directional component. Thus, radially directed cutting jets discharging from a fluid discharge body in the cutting tool may also have an axial and/or peripheral directional component.

Abrasive cutting by means of intersecting cutting jets, along with the associated cutting effect, are known per se, when viewed in isolation, from one particular embodiment of the apparatus according to the above-mentioned US 2004/0089450 A1 (cf. the above discussion of prior art). This apparatus, however, is self-sufficient and, hence, is not structured in a manner allowing it to be connected to a flow-through pipe string for selective remote supply of said abrasive fluid.

Further, each of the other known patent publications discussed above discloses one or more features from the present hydraulic cutting tool. However, none of these patent publications disclose, when viewed in isolation, the combination of features defining the present cutting tool. As such, none of these patent publications describe, either individually or in combination, a hydraulic cutting tool structured in a manner allowing it to cut through (perforate) a pipe wall of a pipe body by means of abrasive and intersecting cutting jets, wherein the cutting tool, for this purpose, also is structured in a manner allowing it to be connected to a flow-through pipe string for selective remote supply of an abrasive fluid for formation of said abrasive cutting jets.

Yet further, and unlike most of the cutting tools discussed in said patent publications, the present hydraulic cutting tool constitutes a relatively simple structure having few or no movable parts. This implies that the present cutting tool provides increased operational reliability and cost effectiveness relative to said known cutting tools.

By means of a cutting tool of the present type, it is also possible to carry out a controlled and relatively precise cutting through the pipe wall of said pipe body, and from internally in the pipe body. By so doing, it is also possible to control the radial cutting range and cutting depth (perforation depth) through the pipe wall of the pipe body.

The simple and operationally reliable structure of the cutting tool is a result of the cutting tool not containing, among other things, an abrasive fluid and a driving means for the fluid, nor a possible control means for the driving means. This stands in stark contrast to the structure and mode of operation of the apparatus according to US 2004/0089450 A1, which is self-sufficient and of a relatively complicated structure (see the above discussion thereof).

When using the present cutting tool, the containment and supply of the abrasive fluid, and also the control of this fluid supply, is carried out from a remote location, for example from the surface of a well. This results in great operational flexibility in the sense that both the volume and composition of the abrasive fluid, and also the volumetric rate, fluid pressure and lapse of time for supply of the abrasive fluid may be controlled selectively and better from the remote location.

Moreover, the mandrel of the cutting tool may be comprised of an assembly of several pipe elements and the like. Thus, each such mandrel element may, for example, be associated with a cutting section and/or anchoring section in the cutting tool.

With respect to said pipe body, it may be comprised of, for example, a casing, liner, production tubing, injection tubing in a well. Alternatively, the pipe body may be comprised of any other tubular object having a pipe wall to be perforated.

Further, the at least one fluid discharge body of the cutting tool may be disposed in the pipe wall of the mandrel. This pipe wall possibly may be thickened in the or those areas where said discharge body is located so as to create enough space for incorporation of said fluid discharge body in the pipe wall.

Yet further, the internal flow channel in the mandrel may be comprised of a central pipe bore. This is the most common and simplest manner of manufacturing such an internal flow channel.

According to one embodiment, the internal flow channel in the mandrel may extend from the first end to the second end of the mandrel, whereby the mandrel is structured for throughput;

wherein the mandrel comprises at least one flow-isolating means structured for selective activation and closing of the flow channel; and wherein said flow-isolating means is disposed between the at least one fluid discharge body and the first end of the mandrel.

Thereby, the cutting tool may be lowered into a pipe body in a well whilst allowing a fluid in the pipe body to flow through the internal flow channel. This ensures that the cutting tool can be lowered into the well with no significant resistance from the fluid in the pipe body.

In the latter embodiment, the at least one flow-isolating means may comprise a ring-shaped receiving seat forming a through opening, the receiving seat of which is disposed around the internal flow channel in the mandrel;

wherein the ring-shaped receiving seat is structured for selective sealing reception of a separate plug body.

Such a plug body may be comprised of a ball or an oblong, arrow-shaped body ("dart") structured in a manner allowing it to be dropped down through said flow channel in order to be received in a sealing manner in said ring-shaped receiving seat therein. By so doing, the flow channel in the mandrel of the cutting tool is closed off to throughput. When viewed in isolation, such balls and arrow-shaped bodies constitute prior art.

As an alternative or addition, the at least one flow-isolating means may comprise a valve device of a suitable type, for example a mechanically or hydraulically activated valve.

Further, the at least one fluid discharge body in the cutting tool may comprise a wear resistant material, for example tungsten carbide or another suitable material. This may prove useful for reducing wear on said fluid discharge body when the cutting jets are reflected from the pipe body during cutting, whereby abrasive fluid splashes back towards the fluid discharge body and exposes it to wear.

Yet further, the at least one fluid discharge body may comprise a shock absorbing material. Thus, such a fluid discharge body may be provided with a shock absorbing material in a backsplash area located between the outwardly directed discharge openings in the fluid discharge body. For example, the shock absorbing material may comprise an elastomer material or another suitable material having a shock absorbing effect when exposed to external forces and influences. This may prove useful for dampening the impact of the abrasive fluid on the fluid discharge body when such an abrasive fluid splashes back towards the fluid discharge body during cutting of the pipe body.

Furthermore, each outwardly directed discharge opening in a fluid discharge body may comprise a nozzle insert configured in a manner allowing it to form said discharging cutting jet of the abrasive fluid.

Possibly, such a nozzle insert may be releasably disposed in the discharge opening via, for example, a suitable threaded connection, quick connection or similar releasable connection. Thereby, a nozzle insert may be easily replaced if necessary, for example in context of wear on or damage to the insert or the nozzle. By so doing, it is also easy to replace one nozzle insert having a specific nozzle size and/or nozzle configuration with another insert having another nozzle size and/or nozzle configuration. Thus, the discharge openings in one or more fluid discharge bodies may have a specific diameter, whereas the corresponding nozzle inserts may have different nozzle sizes and/or nozzle configurations. In this manner, it is easy to adapt the cutting tool to various cutting conditions and cutting requirements.

Such a nozzle insert may also comprise a wear resistant material, for example tungsten carbide or another suitable material. This may prove useful for reducing wear on the nozzle insert when the cutting jets are reflected from the pipe body during cutting, whereby abrasive fluid splashes back towards the nozzle insert and exposes it to wear. Moreover, the nozzle insert possibly may comprise a shock absorbing material of said type.

Further, the cutting tool may comprise at least one centering device structured in a manner allowing it to position the mandrel in a centered manner in the pipe body. This may prove useful for placing several fluid discharge bodies at a best possible equal and predetermined distance from the inside of the pipe body before initiating the hydraulic cutting. As such, the cutting tool may be structured in a manner allowing it to keep the outwardly directed discharge openings in several such fluid discharge bodies at a particular radial distance from the inside of the pipe body, thereby achieving an appropriate and adapted cutting through the pipe wall. This may also prove useful and even necessary for localizing said common intersection point for the cutting jets with relatively high precision so as to achieve the desired cutting result.

For such a centered placement of the mandrel in the pipe body, the at least one radially movable gripping element in said cutting section may be structured in a manner allowing it to center the mandrel in the pipe body when the gripping element is located in its radially extended anchoring position. This implies that the mandrel will be centered in the pipe body when the cutting tool is anchored in the pipe body.

As an alternative or addition, said centering device may comprise at least one stabilizer disposed on the outside of the cutting tool for centered placement of the mandrel in the pipe body. Such stabilizers constitute known centering devices and are normally releasable attached on the outside of the particular object to be centered in a pipe body.

When the cutting tool comprises one or more such centering devices, the at least one fluid discharge body of the cutting tool may therefore be disposed in a stationary manner in the mandrel. This implies that the outwardly directed discharge openings of the fluid discharge body are located at a specific radial distance from the inside of the pipe body when the cutting tool is centered in the pipe body, which also localizes the common intersection point of the cutting jets for one or more fluid discharge bodies in the cutting tool.

In this context, the at least one fluid discharge body possibly may be fixedly integrated in the mandrel of the cutting tool, for example by virtue of the fluid discharge body being formed directly in the mandrel.

As an alternative, the at least one fluid discharge body may be releasably disposed in the mandrel via, for example, a suitable threaded connection, quick connection or similar releasable connection. This may prove useful for replacing one fluid discharge body with another fluid discharge body, for example if the fluid discharge body is worn out or if it is desirable to use a fluid discharge body of another type, size and/or configuration. This renders easy to maintain the cutting tool and, simultaneously, renders easy to adapt the cutting tool to various cutting conditions and cutting requirements. This allows the cutting tool great operational flexibility.

According to another, alternative embodiment, the at least one fluid discharge body of the cutting tool may be structured in a radially movable manner for selective movement of the fluid discharge body between a retracted rest position and a radially extended cutting position. This may prove useful for keeping said fluid discharge body in a retracted and protected position during insertion of the cutting tool into the pipe body. Then, at the particular cutting place in the well, the fluid discharge body may be moved radially outwards to its radially extended cutting position in order to carry out hydraulic cutting through the pipe body. This embodiment implies that the outwardly directed discharge openings of the fluid discharge body are located at a specific radial distance from the inside of the pipe body when the fluid discharge body is in its radially extended cutting position, which also localizes the common intersection point of the cutting jets for one or more such fluid discharge body in the cutting tool. Also in this embodiment, the cutting tool possibly may comprise at least one centering device of said type for centered placement of the mandrel in the pipe body. Moreover, the fluid discharge body and/or the mandrel may comprise suitable ledges, recesses and seals for allowing for radial movements of the fluid discharge body.

In this alternative embodiment, the at least one radially movable fluid discharge body may also be releasably disposed in the mandrel. This results in the same advantageous effects as described above for a stationary fluid discharge body.

For this purpose, such a radially movable fluid discharge body may be slidably disposed in a surrounding sleeve body being releasably disposed in the mandrel. The sleeve body may be releasably connected to the mandrel via a suitable threaded connection, quick connection or similar releasable connection. For example, such a releasable sleeve body may be comprised of a sleeve-shaped ring of a suitable material being releasably attached in a corresponding side opening/bore in the mandrel. As such, a cylindrical sleeve having external threads to be screwed into internal threads in the side opening/bore of the mandrel may be used. The sleeve body may also comprise a wear resistant and/or shock absorbing material.

Further, such a radially movable fluid discharge body may comprise a piston surface for outwardly directed radial movement of the fluid discharge body upon supply of a movement-activating fluid pressure against the piston surface;

wherein the fluid discharge body also is spring-loaded for inwardly directed radial return movement of the fluid discharge body after cessation of the movement-activating fluid pressure against the piston surface.

Said piston surface and spring-loading may be attuned in such a manner that the fluid discharge body will move from its rest position and radially outwards to its cutting position upon supply of a specific fluid pressure against the piston surface. Preferably, this fluid pressure is supplied and exerted by said abrasive fluid. When the fluid discharge body is located in its radially extended cutting position, the pressure in the abrasive fluid is increased to the particular cutting pressure so as to ensure that the abrasive cutting jets discharge at the desired cutting velocity from the fluid discharge body. Upon completion of the cutting operation, the fluid pressure is reduced to below said movement-activating fluid pressure against the piston surface. By so doing, said spring-loading will overcome the reduced fluid pressure so as to ensure that the fluid discharge body returns back to its radially retracted position in the cutting tool. In this context, the fluid discharge body may be spring-loaded by means of one or more elastic springs and/or by means of at least one elastically resilient device, for example an elastic ring or block of a suitable rubber material, including an elastomer material. Furthermore, the fluid discharge body, the piston surface and/or the mandrel may comprise suitable ledges, recesses and seals for allowing for such pressure activation, spring-loading and radial movements of the fluid discharge body.

Yet further, such a radially movable fluid discharge body may comprise a spacer device structured in a manner allowing it to keep outwardly directed discharge openings in the fluid discharge body at a specific radial distance from the inside of the pipe body when the fluid discharge body is located in its radially extended cutting position. Given that such a spacer device will be exposed to the abrasive fluid during the cutting, the spacer device may also comprise a wear resistant and/or shock absorbing material.

Thus, the spacer device may comprise at least one spacer element of a specific length extending radially outwards from the radially movable fluid discharge body. Such a spacer element may be comprised of a by-passable and possibly flow-through spacer pin, sleeve element or spacer structure, for example a lattice structure, of a suitable material extending outwards from the fluid discharge body.

Use of such spacer devices may prove useful in situations where it is difficult to center the cutting tool in the pipe body, whereby the cutting tool assumes a more or less eccentric placement in the pipe body. For example, such a situasjon may arise in a non-vertical pipe body in a deviation well or in a horizontal well. In context of such an eccentric placement, a lower side of the cutting tool will be located closer to the pipe wall of the pipe body than an opposite, upper side of the cutting tool. Thereby, radially movable fluid discharge bodies at the upper side may move radially and farther outwards from the cutting tool than that of radially movable fluid discharge bodies at the lower side of the cutting tool. The uneven radial course of movement of the fluid discharge bodies, however, does not affect the subsequent cutting result given that each such spacer device ensures that the discharge openings in the respective fluid discharge body are kept at a particular distance from the pipe wall of the pipe body. By so doing, a controlled and possibly uniform cutting of holes through the pipe wall is obtained.

Upon using one or more spacer devices of this type, one or more, and possibly all, radially movable fluid discharge bodies in the cutting tool may be kept at a specific distance from the pipe wall of the pipe body during the cutting through the pipe wall. Possibly, and if desirable, the radially movable fluid discharge bodies may also be customized with a different radial distance from the pipe wall of the pipe body. In this manner, the common intersection point of the cutting jets for one or more radially movable fluid discharge bodies may be controlled and localized in a suitable manner, and possibly may be adapted individually. This may prove useful if, for example, different hole profiles and/or hole sizes are desired in the pipe wall, or possibly if substantially uniform holes are desired through the pipe wall.

Such a spacer device may also be releasably connected to the radially movable fluid discharge body. This may also prove useful for replacing one spacer device with another spacer device, for example if the spacer device is worn out, or if changing said radial distance for the fluid discharge body is desirable. This renders easy to carry out maintenance and also to adapt the cutting tool to various cutting conditions and cutting requirements. This also allows the cutting tool great operational flexibility.

The cutting tool may also comprise at least one movement limitation device structured in a manner allowing it to limit the radial movement of the fluid discharge body outwards from the mandrel. This may prove useful for ensuring that the radially movable fluid discharge body, when located in its radially extended cutting position, maximally may be moved a specific radial distance outwards from the mandrel. If the cutting tool can be centered sufficiently well in the pipe body, for example by means of externally placed stabilizers, this may prove to be a suitable manner of positioning the fluid discharge body at a specific radial distance from the inside of the pipe body.

Such a movement limitation device may be comprised of a retaining element or a retaining structure extending outwards from the mandrel of the cutting tool so as to limit the maximum movement of the fluid discharge body radially outwards from the mandrel.

As an alternative or addition, such a movement limitation device may also comprise at least one stop device disposed in the radially movable fluid discharge body. The movement limitation device may therefore comprise one or more stop rings or similar connected to the fluid discharge body so as to ensure that it can move only a specific radial distance outwards from the mandrel.

Further, at least one cutting section in the cutting tool may comprise an assembly of at least two fluid discharge bodies distributed around the cutting section. Thereby, each fluid discharge body is structured in a manner allowing it to form a corresponding hole through the pipe wall of the pipe body.

Thus, at least one cutting section may comprise an assembly of several fluid discharge bodies distributed in a predetermined pattern around the cutting section, wherein the several fluid discharge bodies are structured in a manner allowing them to form a corresponding predetermined pattern of holes through the pipe wall of the pipe body. In this context, said pattern may extend both in the peripheral and axial directions around the cutting section. In this manner, the cutting tool may be structured in a manner allowing it to cut holes having a predetermined density and distribution through the pipe wall.

Yet further, the mandrel of the cutting tool may comprise at least two cutting sections disposed successively along the mandrel. This may prove useful in the event that cutting sections having various types, configurations and/or patterns of fluid discharge bodies in each cutting section are desirable. This may also prove useful for replacing a worn out cutting section with a new, successive cutting section. In this context, fluid flow paths, fluid discharge bodies and possible nozzles in the former cutting section being worn out due to throughput of the abrasive cutting fluid, may be involved. By incorporating, in this manner, two or more cutting sections in the cutting tool, it is possible to avoid several trips, possibly to reduce the number of trips, down into a well in order to carry out a cutting operation in the well. This is of particularly great importance in offshore wells encumbered with extremely large operating costs.

In this context, a flow-isolating means may be disposed between neighbouring cutting sections along the mandrel, wherein such a flow-isolating means is structured for selective activation and closing of the flow channel between such neighbouring cutting sections. This allows for individual activation of successive cutting sections along the mandrel.

According to one embodiment, this flow-isolating means may comprise a ring-shaped receiving seat forming a through opening, the receiving seat of which is disposed around the internal flow channel in the mandrel;

wherein the ring-shaped receiving seat is structured for selective sealing reception of a separate plug body.

As mentioned, such a plug body may be comprised of a ball or an oblong, arrow-shaped body structured in a manner allowing it to be dropped down through said flow channel in order to be received in a sealing manner in the ring-shaped receiving seat between the neighbouring cutting sections. Thereby, the flow channel between these cutting sections is closed off to throughput.

As an alternative or addition, the at least one flow-isolating means may comprise a valve device of a suitable type, for example a mechanically or hydraulically activated valve.

For a mandrel provided with more than two successive cutting sections, the flow channel between each pair of such neighbouring cutting sections may be associated with such a flow-isolating means. If the flow-isolating means is comprised of a ring-shaped receiving seat of said type, both the receiving seat and the associated, separate plug body obviously must have a larger diameter for each successively overlying pair of neighbouring cutting sections along the mandrel. Herein, the term "overlying" implies a position located shallower than that of the (underlying) position referred to.

Each such receiving seat may also be disposed in a sleeve or similar disposed in an axially movable manner in said flow channel, the sleeve of which initially covers and prevents fluid communication with the fluid discharge bodies in an immediately overlying cutting section. When in this fluid-isolating position, the sleeve may be releasably connected to the mandrel via, for example, shear pins or similar releasable connections. Upon having dropped the separate plug body down through the flow channel and having received it in a sealing manner in the ring-shaped receiving seat of the sleeve, the fluid pressure in the flow channel may be increased until said shear pins are severed. Then, the fluid pressure will drive the sleeve and its receiving seat and plug body axially downwards onto a stop seat or similar formed in the mandrel. By so doing, the sleeve uncovers the fluid discharge bodies in the immediately overlying cutting section so as to open to fluid communication with the fluid discharge bodies. In this manner, new and overlying cutting sections may be opened successively for cutting, whereas used and underlying cutting sections may be closed off to fluid throughput.

Yet further, and according to one embodiment, at least one anchoring section in the cutting tool may comprise an assembly of at least two radially movable gripping elements distributed around such an anchoring section. Advantageously, the at least two gripping elements may be distributed at an equal peripheral distance around the anchoring section. This may prove useful for achieving a best possible centering and anchoring of the mandrel in the pipe body during a cutting operation.

Such a radially movable gripping element may comprise at least one slip segment of a type and shape known per se.

As an alternative or addition, such a radially movable gripping element may comprise a flexible and expandable gripping body. Thus, the flexible and expandable gripping body may comprise an inflatable body, such as a balloon-resembling body.

Moreover, the at least two radially movable gripping elements may be aligned along a common circumferential line around such an anchoring section.

According to another, alternative embodiment, at least one anchoring section in the cutting tool may comprise a radially movable gripping element in the form of a flexible and expandable gripping body enclosing such an anchoring section. Thus, this gripping body may comprise an inflatable body, for example a balloon-resembling body, completely enclosing the anchoring section.

Upon using at least two radially movable gripping elements aligned along a common circumferential line, or upon using a radially movable gripping element in the form of a flexible, expandable and enclosing gripping body, such an anchoring section may be disposed in proximity of a cutting section. By so doing, the anchoring section and the cutting section constitute an assembly thereof. This may prove useful if the radially movable gripping elements or the expandable and enclosing gripping body are structured for hydraulic activation and radial movement by means of a suitable fluid being supplied to the gripping elements or the gripping body. Advantageously, this fluid may be comprised of the abrasive fluid, whereby the same fluid is used both for anchoring of the cutting tool and for subsequent cutting therewith.

Further, at least one anchoring section in the cutting tool may be disposed between the at least one cutting section and the first end of the mandrel. When the cutting tool anchored within a pipe body in a well, this implies that such an anchoring section will be located at a lower portion of the cutting tool, and below said cutting section. Thereby, one or more radially extended gripping elements in the anchoring section will not be able to prevent fluid flow between the cutting tool and the pipe body during a cutting operation in the well. This embodiment may prove useful when the cutting tool comprises one or more cutting sections being activated simultaneously for cutting through the pipe wall of the pipe body.

Yet further, and as an alternative or addition, at least one anchoring section in the cutting tool may be disposed between the at least one cutting section and the second end of the mandrel. When the cutting tool is anchored within a pipe body in a well, this implies that such an anchoring section will be located at an upper portion of the cutting tool, and above said cutting section. Thereby, one or more radially extended gripping elements in the anchoring section will be able to prevent fluid flow between the cutting tool and the pipe body during a cutting operation in the well. In this context, it is therefore important that the at least one gripping element is structured in a manner allowing fluid flow through and/or past the gripping element during the cutting operation. This embodiment may prove useful when the at least one gripping element of the anchoring section is activated and moved hydraulically, and when the cutting tool comprises several successive cutting sections being activated separately for cutting through the pipe wall of the pipe body (cf. the above discussion thereof). According to such an embodiment, supply of a suitable fluid, for example the abrasive so fluid, must be allowed to the at least one gripping element of the anchoring section for hydraulic anchoring and releasing of each successive and separate cutting section employed. Such a fluid supply, however, will be impossible if the anchoring section is disposed at a lower portion of the cutting tool, and if the flow channel above the anchoring section is closed off by means of said flow-isolating means. In such a situation, the anchoring section must therefore be disposed above the successive cutting sections in the cutting tool.

According to a second aspect of the invention, a system is provided for controlled hydraulic cutting through a pipe wall, wherein the system comprises the following combination of features:

- a well;
- a first pipe body disposed in the well and comprising said pipe wall;
- a second pipe body disposed in the well and located outside and around the first pipe body;
- a pipe string disposed within the first pipe body; and
- an abrasive fluid source connected in a flow communicating manner to an upper portion of the pipe string.

The distinctive characteristic of the system is that it also comprises a hydraulic cutting tool according to the first aspect of the invention connected to a lower portion of the pipe string for formation of at least one hole through the pipe wall of the first pipe body; and wherein said common intersection point for the non-parallel discharge directions from the at least one fluid discharge body in the cutting tool is located, when in its cutting position, some place between a minimum distance and a maximum distance, as measured in the radial direction from the outwardly directed discharge openings in each such fluid discharge body, wherein said minimum distance is defined by a midpoint between said discharge openings and an inside of the first pipe body, and wherein said maximum distance is defined by a midpoint between an outside of the first pipe body and an inside of the second pipe body.

Thereby, the system is structured for selective remote supply of the abrasive fluid from said abrasive fluid source and onto the hydraulic cutting tool. Thereby, the system is also structured in a manner allowing it to form abrasive cutting jets discharging at high velocity from said discharge openings in each fluid discharge body and cutting into and through the pipe wall of the first pipe body, thus forming at least one hole through this pipe wall. This also implies that the system is structured in a manner allowing it to form abrasive cutting jets meeting and dispersing in said intersection point, thus weakening the further cutting ability of the cutting jets on the second pipe body after formation of said hole through the pipe wall of the first pipe body.

Insofar as the present system makes use of a hydraulic cutting tool according to the first aspect of the invention, all of the above comments and constructive features of this cutting tool also apply in context of the system.

Furthermore, said first and second pipe bodies may be comprised of, for example, casings, liners, production tubings, injection tubings or similar.

The particular location (radial distance from the fluid discharge body) selected for the common intersection point of the cutting jets relative to the pipe wall of the first pipe body is determined based on the existing requirements, conditions and surroundings, and possibly via prior tests simulating the existing conditions and elements in the well.

Further, a minimal radial distance between the outside of the first pipe body and the inside of the second pipe body may be determined by a radial thickness of a pipe collar for the first pipe body. This may be important for determining said maximum distance for said common intersection point for the non-parallel discharge directions from the at least one fluid discharge body. Such a pipe collar, which is provided with internal threads, is disposed at one end of the pipe body, whereas an opposite end of the pipe body is provided with external threads. Thereby, several such pipe bodies may be screwed together and connected together sequentially for formation of a pipe string of such pipe bodies. Such pipe collars and such an interconnection of the pipe bodies constitute prior art per se. When a pipe string of first pipe bodies is placed maximally eccentrically within a pipe string of second pipe bodies, the radial thickness of the pipe collar of the first pipe body will define the minimal radial distance between the first pipe body and the second pipe body in the well. For example, such a tubular constellation may exist in a deviation well or horizontal well. The radial thickness of said pipe collar may be in the order of 1-2 cm for pipe bodies typically used in a well. In context of such an eccentric placement of the first pipe body, the thickness of said pipe collar may therefore be very important for determining the maximum distance for said intersection point.

According to one embodiment, said common intersection point may be located some place between said minimum distance and the outside of the first pipe body.

This implies that the intersection point, in a first variant of this embodiment, may be located some place between said minimum distance and the inside of the first pipe body. Such a location of the intersection point may be appropriate for cutting through a first pipe body having a relatively thin pipe wall, and/or through a pipe wall formed of a material (other than steel) being relatively easy to cut through, for example aluminum or another light metal or metallic alloy material. Upon allowing, in this manner, the abrasive cutting jets to intersect and collide before hitting the pipe wall, the radial cutting ability of the cutting jets will be weakened before hitting the pipe wall. By so doing, a more gentle and slower cutting action is achieved than that of a corresponding case where the intersection point is located in or on the outside of the pipe wall. Further, the hole thus formed through the pipe wall will tend mostly to assume a more or less unitary cross section through the pipe wall, and then potentially of a more or less cylindrical shape. Such a slower cutting also provides more time to control the cutting through the pipe wall and also to complete the cutting before the cutting jets cut through the pipe wall of the second, enclosing pipe body.

In a second variant of this embodiment, the common intersection point may be located some place in the pipe wall of the first pipe body, i.e. between the inside and the outside of this pipe body. Such a location of the intersection point may be appropriate for cutting through a first pipe body of steel having, possibly, a standard thickness of the pipe wall. The farther into the pipe wall this intersection point is located, the farther into the pipe body the abrasive cutting jets may dig at full cutting force and cutting ability before colliding and being weakened in the intersection point. During the courses of flow of the cutting jets onto collision in the intersection point, and due to their obliqueness relative to the pipe wall, the cutting jets will be reflected from the pipe wall so as to effectively remove pipe material from the pipe wall. After the collision, the weakened cutting jets will form turbulent and/or multi-directional flow within a limited cavity in the pipe wall, whereupon the cutting jets will tend to dig laterally and circularly within the cavity. This cutting action and course of cutting may therefore cause the hole being formed through the pipe wall to assume, along with a diminishing cross section in the downstream direction, a more or less conical shape onto the intersection point in the pipe wall, and then to assume a more or less cylindrical shape onwards through the pipe wall. This implies that the hole tends to become more conical the farther into the pipe wall said intersection point is located. This also implies that an intersection point that is placed near the inside of the pipe wall tends mostly to result in a more or less cylindrical hole through the entire pipe wall. This second variant of the embodiment also ensures a relatively good control of the course of cutting through the pipe wall.

Thus, the common intersection point may be located approximately midway in the pipe wall of the first pipe body. Such a central location of the intersection point therefore tends to result in an effective cutting action from the cutting jets, wherein the hole through the pipe wall assumes a relatively unitary cross section through the pipe wall.

In another, alternative embodiment, said common intersection point may be located some place between the outside of the first pipe body and said maximum distance. Such a location of the intersection point may be appropriate for cutting through a first pipe body of steel having, possibly, a larger thickness of the pipe wall than that considered to be a standard thickness. Such a location may also be appropriate if the annulus between the first and second pipe body contains solid particles, such as cement, rocks and/or precipitated drilling mud particles. Insofar as the intersection point is located outside the first pipe body, the abrasive cutting jets will dig at full cutting force and cutting ability through the entire pipe wall before colliding and being weakened in the intersection point. This cutting action tends mostly to cause the hole thus formed through the pipe wall to assume a more or less conical shape having a diminishing cross section in the downstream direction. Such an external location of the intersection point therefore tends to provide the cutting jets with a very effective cutting action through the pipe wall of the first pipe body. Simultaneously, the collision of the cutting jets in the annulus between the first and second pipe body will ensure that the cutting ability of the cutting jets is weakened sufficiently in the annulus so as not to perforate or significantly damage the pipe wall of the surrounding, second pipe body.

According to a third aspect of the invention, a method is provided for controlled hydraulic cutting through a first pipe body in a well, and from internally in the first pipe body, and without cutting through a pipe wall of a second pipe body located outside and around the first pipe body in the well.

The distinctive characteristic of the method is that it comprises the following combination of steps:

(A) using a hydraulic cutting tool according to the first aspect of the invention;

(B) connecting the second end of the mandrel of the cutting tool, and thus the cutting tool, to a lower portion of a flow-through pipe string;

(C) lowering the pipe string and its connected cutting tool into the first pipe body until the cutting tool is located at a longitudinal section of the well where at least one hole is to be formed through the pipe wall of the first pipe body;

(D) selectively activating the at least one gripping element in the anchoring section of the cutting tool so as to move said gripping element radially outwards until engagement with an inside of the first pipe body, thereby anchoring the cutting tool in the first pipe body;

(E) disposing the outwardly directed discharge openings in the at least one fluid discharge body in the at least one cutting section of the cutting tool at a predetermined radial distance from the inside of the first pipe body, wherein the predetermined radial distance is selected such that said common intersection point for the non-parallel discharge directions from said fluid discharge body is located, when in its cutting position, some place between a minimum distance and a maximum distance, as measured in the radial direction from the outwardly directed discharge openings in each such fluid discharge body, wherein said minimum distance is defined by a midpoint between said discharge openings and the inside of the first pipe body, and wherein said maximum distance is defined by a midpoint between an outside of the first pipe body and an inside of the second pipe body;

(F) selectively pumping, from an abrasive fluid source connected in a flow communicating manner to an upper portion of the pipe string, the abrasive fluid down through the pipe string and the mandrel of the cutting tool in order to discharge as abrasive cutting jets from said discharge openings in said fluid discharge body in at least one cutting section in the cutting tool;

whereby said abrasive cutting jets, which discharge at high velocity from said discharge openings in each fluid discharge body, cut into and through the pipe wall of the first pipe body, thus forming at least one hole through the pipe wall; and whereby the abrasive cutting jets also meet and disperse in said intersection point, thus weakening the further cutting ability of the cutting jets on the second pipe body after formation of said hole through the pipe wall of the first pipe body;

(G) terminating the pumping of the abrasive fluid after a predetermined period of time corresponding to, as a minimum, the time required to cut the at least one hole through the pipe wall of the first pipe body at the existing conditions in the well; and (H) selectively deactivating the at least one gripping element so as to move said gripping element radially inwards from the first pipe body, thereby releasing the cutting tool from its engagement with the first pipe body.

Upon terminating, in step (G), the pumping of the abrasive fluid after said predetermined period of time, the method provides a very simple way, and also a simple decision criterion, for determining when said holes have been cut through the pipe wall of the first pipe body, however without simultaneously perforating or significantly damaging the pipe wall of the surrounding, second pipe body in the well. By so doing, the method also provides a very simple way of controlling the perforation depth in the radial direction outwards from the cutting tool.

Referring to step (G) in the method, said existing conditions in the well may comprise a number of factors, such as pressure and temperature at the cutting place in the well; well angle; composition and properties of the abrasive fluid used for the cutting; pump pressure and pump rate; properties of the discharge openings, and possible nozzles therein, of the fluid discharge body; the angle between the discharge openings of the fluid discharge body; the number of fluid discharge bodies; the radial distance from the fluid discharge body onto the first pipe body; the location of the common intersection point of the cutting jets; and also material type and thickness of the first pipe body.

Insofar as the present method makes use of a hydraulic cutting tool according to the first aspect of the invention, and also a system according to the second aspect of the invention, all of the above comments and constructive features of the present cutting tool and system also apply in context of the method.

Further, the method may comprise, in step (G), determining the predetermined period of time via at least one prior test reflecting the existing conditions in the well. Thus, said period of time may be determined via one or more tests carried out at the surface, the tests of which simulate the existing conditions in the well. As an alternative or addition, the period of time may be determined by using the cutting tool to cut through the pipe wall of the first pipe body at a shallow level in the well, for example on the way down into the well in order to carry out hydraulic cutting at a deeper level in the well. The point in time of cutting through (perforating) the pipe wall is recorded by observing pressure changes in an annulus located immediately as outside the first pipe body. By so doing, the period of time for perforating may be determined in relation to the relevant pipe body, and at the existing conditions in the well. Such a shallow perforation does not have to affect the integrity of the well if, for example, this and possible other pipe bodies in the well subsequently is/are removed in context of plugging and abandonment of the well (so-called P&A). Moreover, both determination methods may prove useful for verifying that said predetermined period of time is as correct as possible for the particular cutting purpose in the well.

Yet further, a minimal radial distance between the outside of the first pipe body and the inside of the second pipe body may be determined by a radial thickness of a pipe collar for the first pipe body. As mentioned in context of the present system, the radial thickness of said pipe collar may be in the order of 1-2 cm for pipe bodies typically used in a well. This may be important for determining said maximum distance for the intersection point for the non-parallel discharge directions from the at least one fluid discharge body, and especially when the first pipe body is placed maximally eccentrically within the second pipe body.

According to one embodiment, said common intersection point may be located some place between said minimum distance and the outside of the first pipe body.

In a first variant of this embodiment, the common intersection point may therefore be located some place between said minimum distance and the inside of the first pipe body, which possibly may have a relatively thin pipe wall formed of another and weaker material than steel. In this manner, and as mentioned, a more gentle and slower cutting action may be achieved, the cutting action of which also tends to form a hole having a substantially unitary cross section through the pipe wall of the first pipe body, and then potentially of a cylindrical shape.

In a second variant of this embodiment, the common intersection point may be located some place in the pipe wall of the first pipe body, which possibly may be a standard pipe body of steel. In this manner, and as mentioned, a relatively effective removal of pipe material from the pipe wall may be achieved, simultaneously allowing the hole through the pipe wall to assume a conical and/or cylindrical shape. This second variant of the embodiment also ensures a relatively good control of the course of cutting through the pipe wall of the first pipe body.

Thus, the common intersection point may be located approximately midway in the pipe wall of the first pipe body. As mentioned, such a central location of the intersection point may result in an effective cutting action from the cutting jets, wherein the hole through the pipe wall assumes a relatively unitary cross section.

In another, alternative embodiment, said common intersection point may be located some place between the outside of the first pipe body and said maximum distance. In this manner, and as mentioned, a very effective cutting action through the pipe wall of the first pipe body may be achieved, the pipe body of which possibly may have a relatively thick pipe wall of steel. Such a location of the intersection point may also be appropriate if the annulus between the first and second pipe body contains solid particles, such as cement, rocks and/or precipitated drilling mud particles.

Further, the internal flow channel in said mandrel may extend from the first end to the second end of the mandrel, whereby the mandrel is structured for throughput;

wherein the mandrel comprises at least one flow-isolating means structured for selective activation and closing of the flow channel; and wherein the flow-isolating means is disposed between said fluid discharge body and the first end of the mandrel; and wherein the method also comprises:

lowering, in step (C), the pipe string and its connected cutting tool into the first pipe body with the internal flow channel being open to throughput; and selectively activating and closing off, before step (F), the internal flow channel by means of the flow-isolating means.

In this manner, and as mentioned, the cutting tool may be lowered into the first pipe body whilst allowing a fluid in the pipe body to flow through the internal flow channel. This ensures that the cutting tool can be lowered into the well with no significant resistance from the fluid in the pipe body.

According to one embodiment, the at least one fluid discharge body may be structured so as to be stationary. This implies, as mentioned, that the outwardly directed discharge openings of the fluid discharge body are located at a specific radial distance from the inside of the pipe body when the cutting tool is centered in the pipe body, which also localizes the common intersection point of the cutting jets for one or more fluid discharge bodies in the cutting tool.

According to another, alternative embodiment, the at least one fluid discharge body may be structured so as to be radially movable;

wherein the method comprises, in step (E), selectively moving the fluid discharge body until being positioned at said predetermined radial distance from the first pipe body.

Among other things, this may prove useful for keeping said fluid discharge body in a retracted and protected position during insertion of the cutting tool into the pipe body. Reference is made herein to the above discussion of the cutting tool for further details of such a radially movable fluid discharge body and the mode of operation thereof.

Further, at least one cutting section in the cutting tool may comprise an assembly of at least two fluid discharge bodies distributed around the cutting section. Thereby, and in steps (F) and (G) of the method, at least two corresponding holes are formed through the pipe wall of the first pipe body.

Thus, at least one cutting section may comprise an assembly of several fluid discharge bodies distributed in a predetermined pattern around the cutting section. Thereby, and in steps (F) and (G) of the method, a corresponding pattern of holes is formed through the pipe wall of the first pipe body.

Yet further, the mandrel of the cutting tool may comprise at least two cutting sections disposed successively along the mandrel;

wherein a flow-isolating means is disposed between neighbouring cutting sections along the mandrel; and wherein the method comprises, before step (F), selectively activating and closing off said flow channel between such neighbouring cutting sections by means of the associated flow-isolating means, which allows for individual activation of successive cutting sections along the mandrel.

Also in this context, reference is made to the above discussion of the cutting tool for further details of said constructive features and the mode of operation thereof.

Moreover, the abrasive fluid may comprise drilling mud admixed with abrasive particles, wherein the pipe walls of the first pipe body and the second pipe body are comprised of steel; and wherein the method comprises, in step (F), pumping the abrasive fluid at a flow rate providing the abrasive cutting jets, which are discharging from said discharge openings in the at least one fluid discharge body, with a discharge velocity in the order of 90-140 m/s.

These are empirical discharge velocities based on a series of tests in which an abrasive drilling mud has been used to cut holes through pipe walls made of steel.

In this context, the abrasive fluid possibly may be pumped at a flow rate providing the abrasive cutting jets with a flow velocity being less than 75 m/s after collision of the cutting jets in said common intersection point. Such a flow velocity results in little or no adverse effect on the surrounding, second pipe body. From said tests, it has thus proven beneficial to use a flow velocity (after collision of the cutting jets) being in the order of 55-75 m/s.

Upon completion of the hydraulic cutting, and after step (H), the method may also comprise the following steps:

(I) pumping a washing fluid down into the first pipe body onto said longitudinal section of the well where the at least one hole has been formed through the pipe wall of the first pipe body; and (J) washing, by means of the washing fluid, the first pipe body, hence also an annulus located between the first pipe body and the second pipe body via the at least one hole, within at least said longitudinal section of the well.

By so doing, both the first pipe body and said annulus are cleaned along at least said longitudinal section of the well.

As an alternative or addition, the method may also comprise, after step (H), the following steps:

(K) pumping a fluidized plugging material down into the first pipe body onto said longitudinal section of the well where the at least one hole has been formed through the pipe wall of the first pipe body; and (L) placing the fluidized plugging material in the first pipe body, hence also in an annulus located between the first pipe body and the second pipe body via the at least one hole, within at least said longitudinal section of the well.

By so doing, both the first pipe body and said annulus are plugged along at least said longitudinal section of the well.

In this manner, a plug may be formed in the first pipe body and in said annulus. The fluidized plugging material may comprise cement slurry, which constitutes the most common plugging material, for formation of a plug in a well. As a somewhat unusual alternative, the fluidized plugging material may comprise a fluidized particulate mass for formation of a plug in a well. Among other places, such a fluidized particulate mass is described in WO 01/25594 A1 and in WO 02/081861 A1.

Furthermore, such a well plug may be established by means of a method and a washing tool as depicted and described in Norwegian patent application No. 20111641, entitled "Method for combined cleaning and plugging in a well, a washing tool for directional washing, and also use of the washing tool". NO 20111641 corresponds to international publication WO 2012/096580 A1, and the method and the washing tool is marketed under the name HydraWash™.

Such a well plug may also be established by means of a method and a flushing tool as depicted and described in Norwegian patent application No. 20120277, entitled "Method for combined cleaning and plugging in a well, and also a flushing tool for flushing in a well". NO 20120277 corresponds to WO 2013/133719 A1, and the method and the flushing tool is marketed under the name HydraHemera™, or quite simply Hemera™.

SHORT DESCRIPTION OF THE FIGURES

Hereinafter, non-limiting examples of embodiments of the present method are described.

Figure 1:
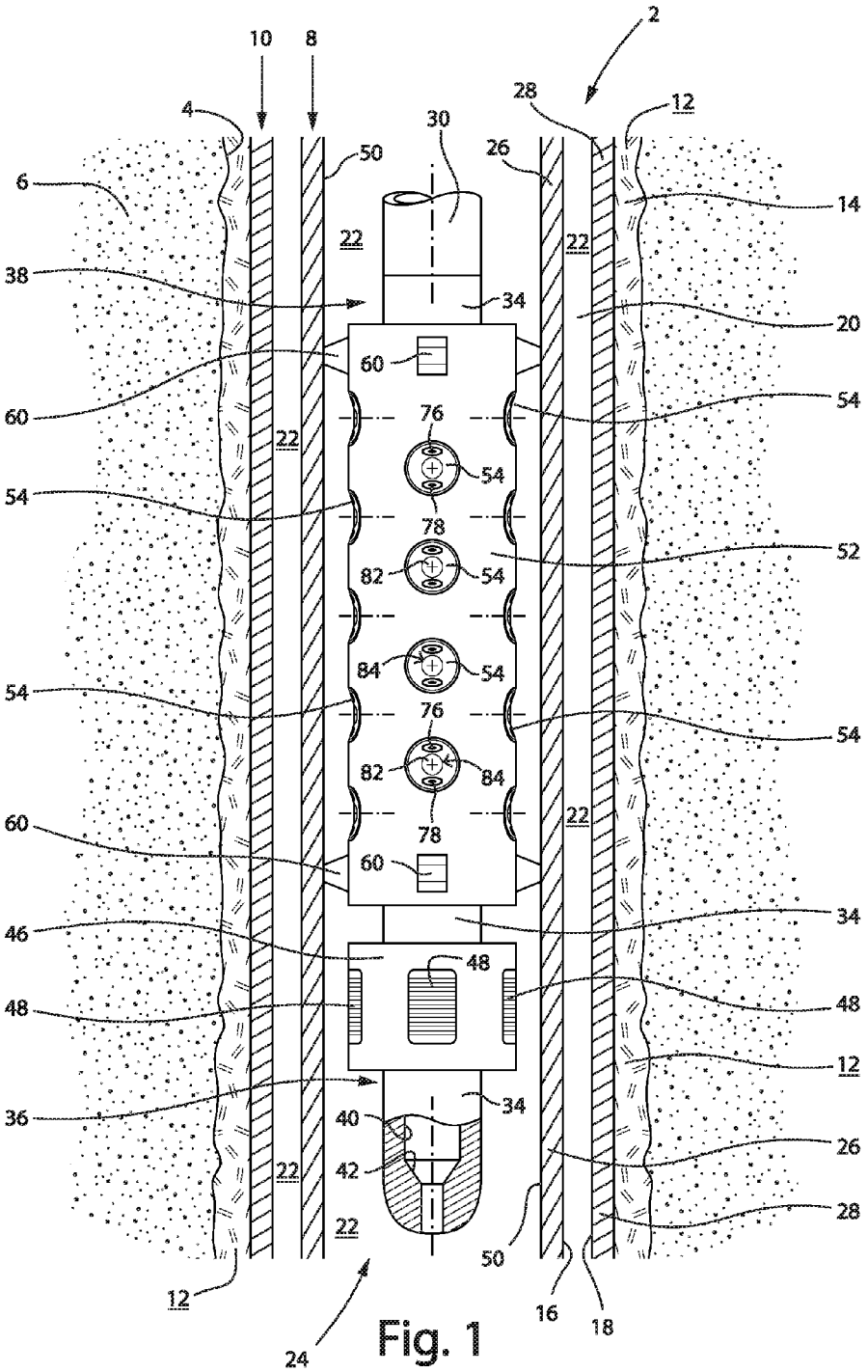
FIGS. 1-7 show an embodiment of a first hydraulic cutting tool according to the invention placed in a petroleum well and provided with stationary and replaceable fluid discharge bodies disposed in only one cutting section along the cutting tool.
Figure 2:
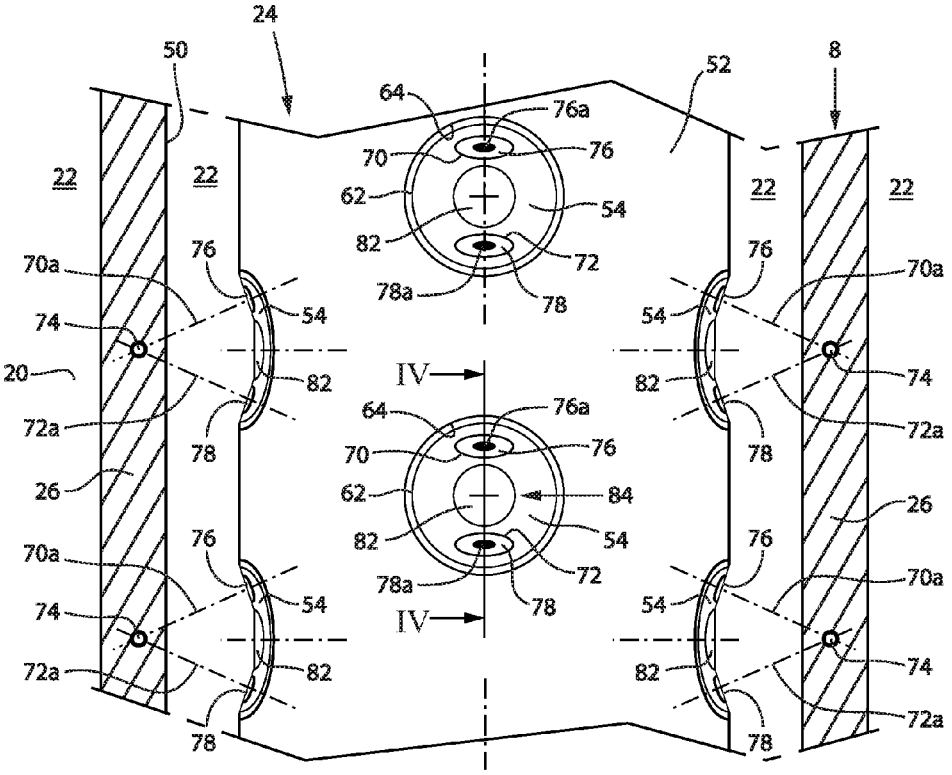
Figure 3:
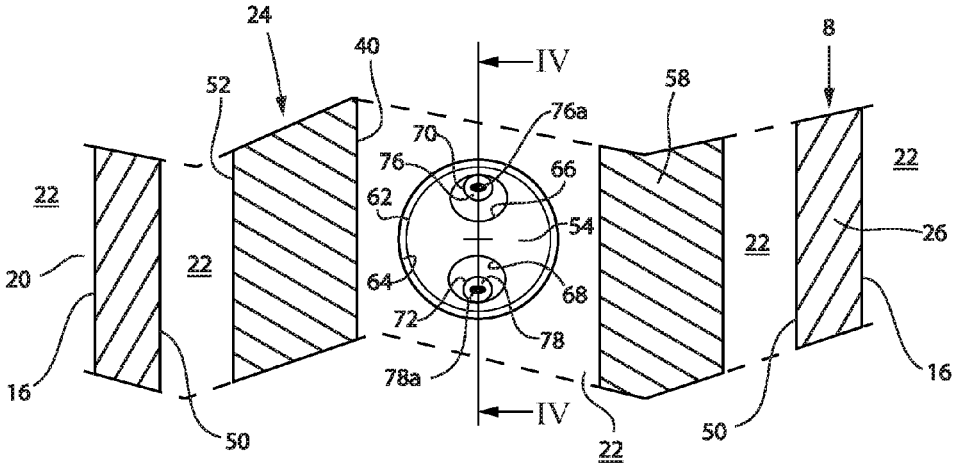
Figure 4:
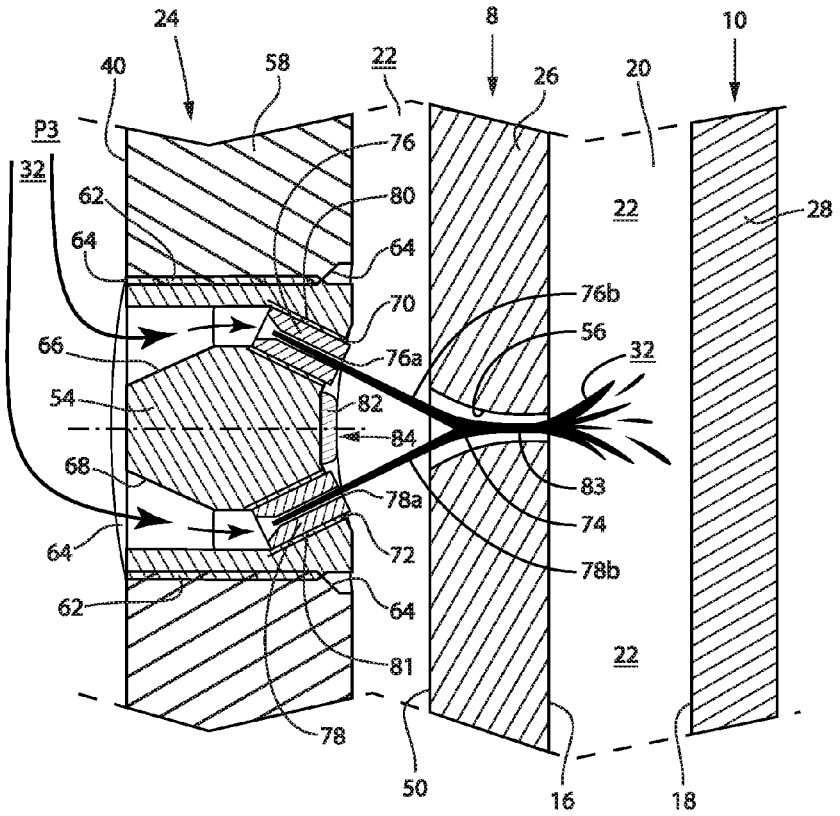
Figure 5:
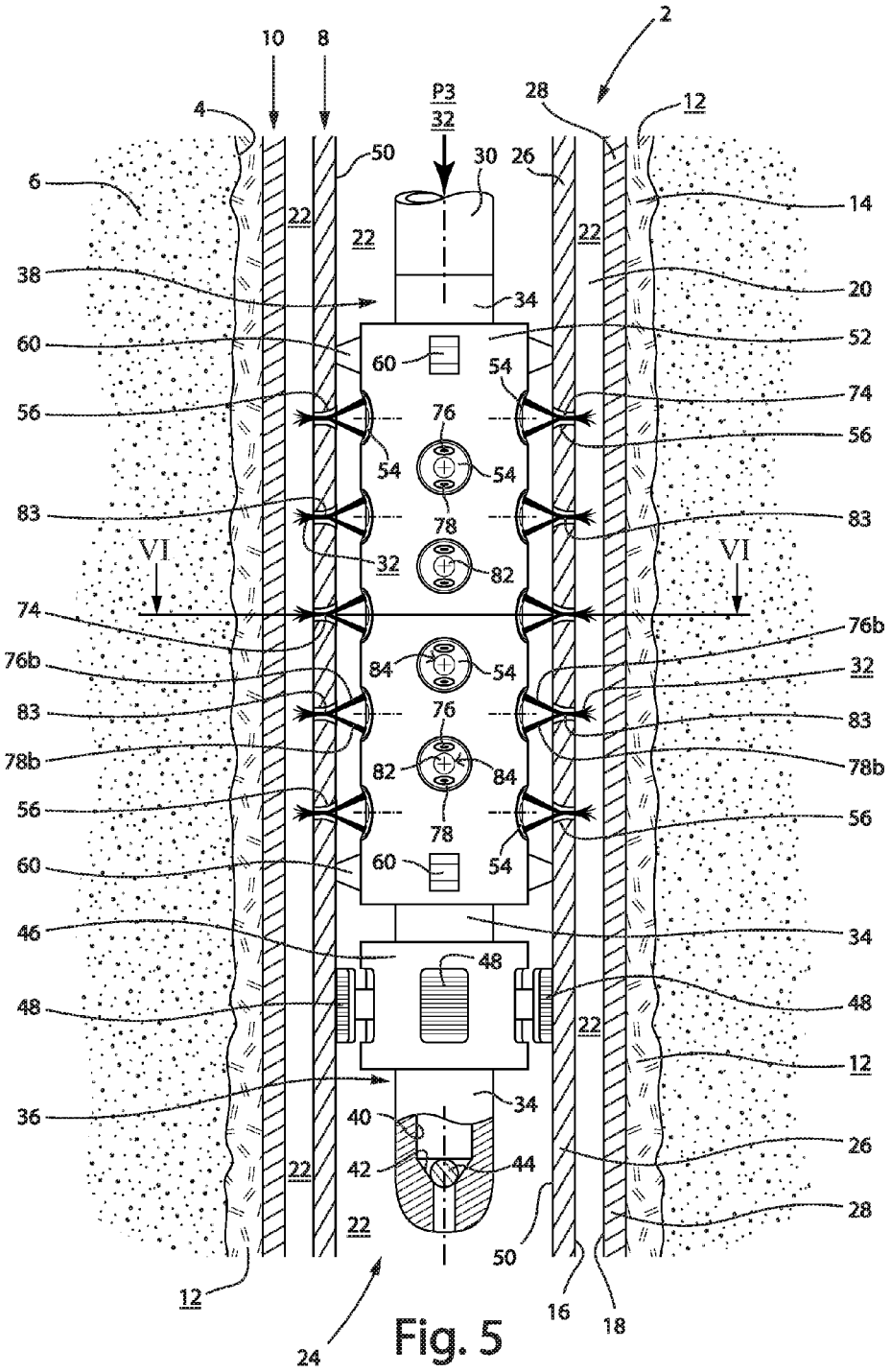
Figure 6:
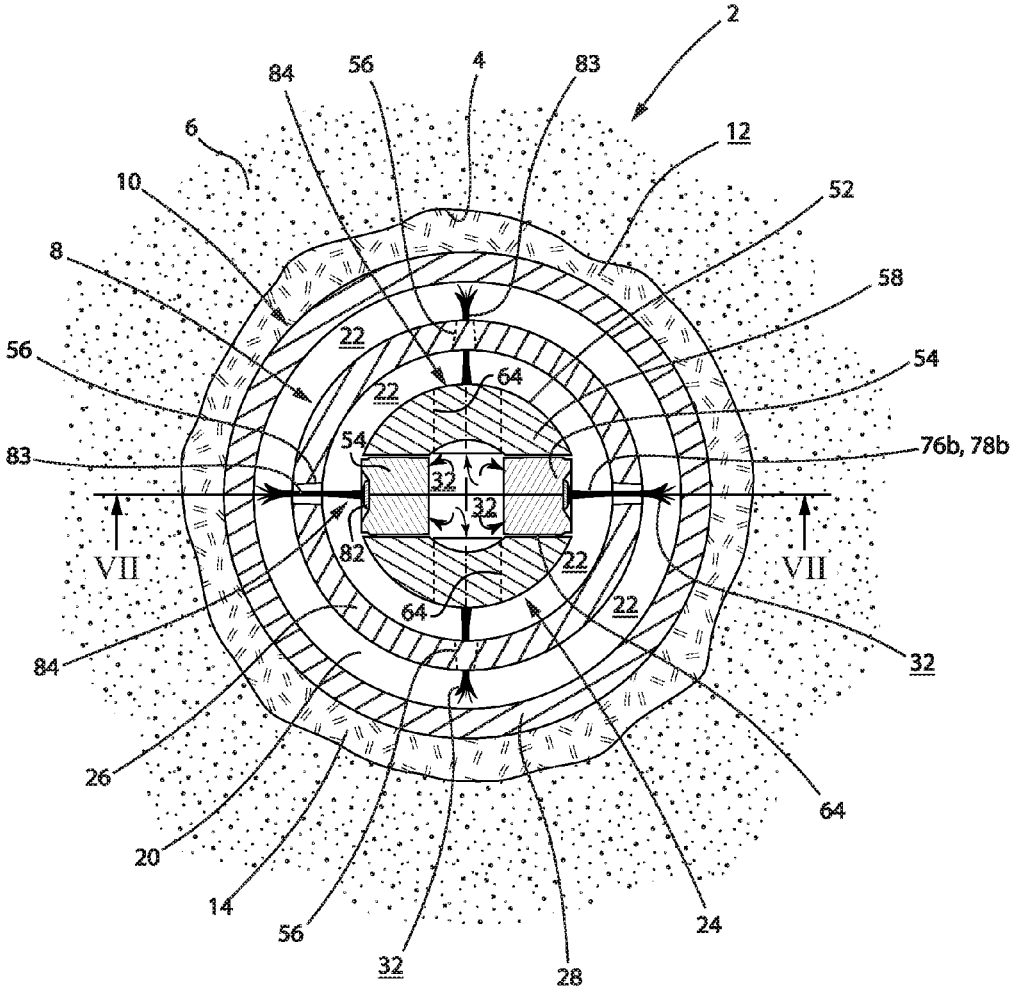
Figure 7:
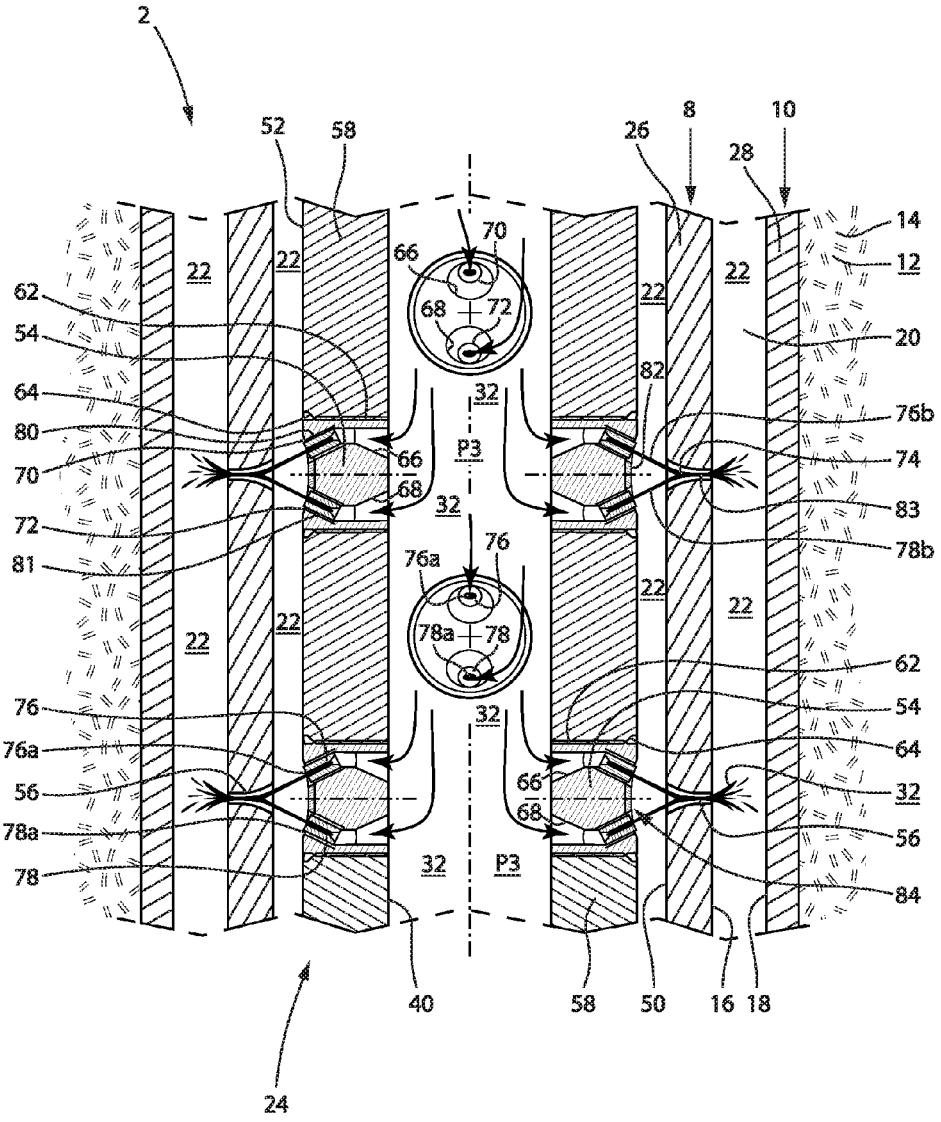
Figure 8:
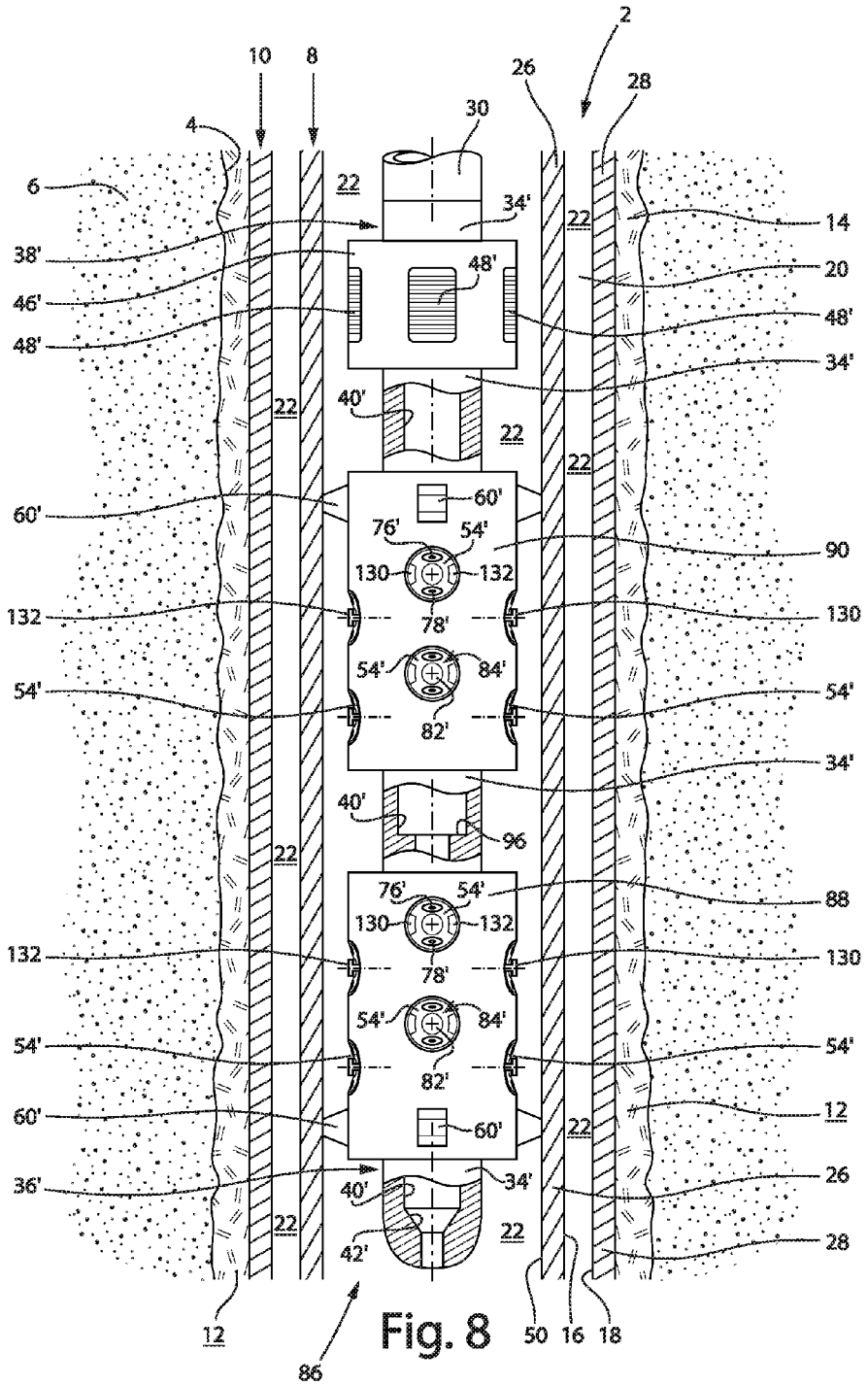
FIGS. 8-16 show an embodiment of a second hydraulic cutting tool according to the invention placed in said petroleum well and provided with radially movable and replaceable fluid discharge bodies disposed in two successive cutting sections along the cutting tool.
Figure 9:
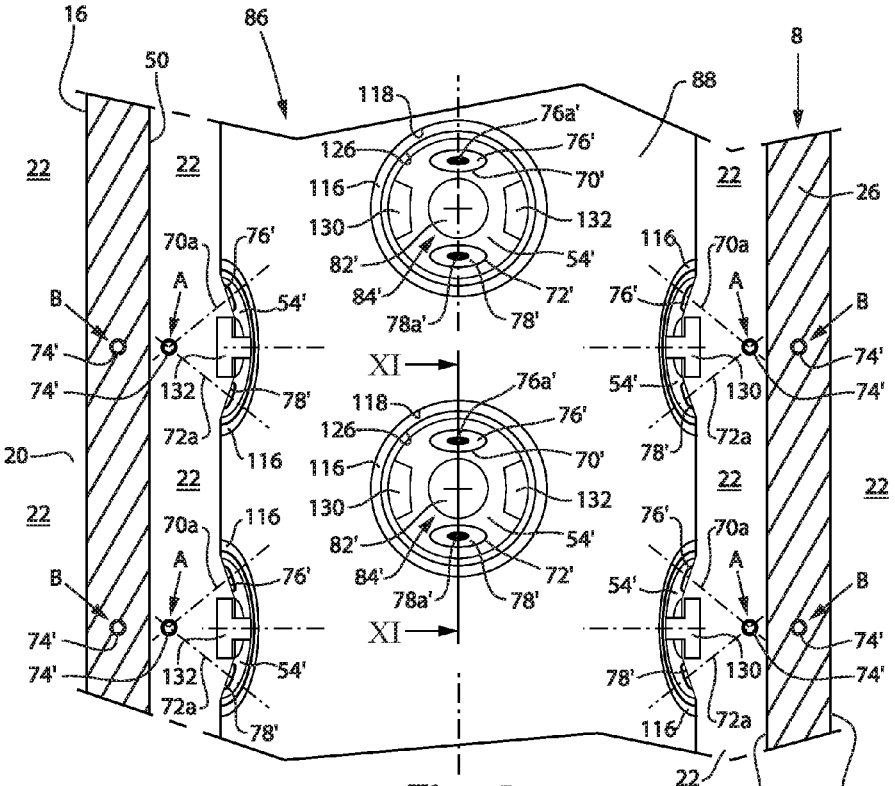
Figure 10:
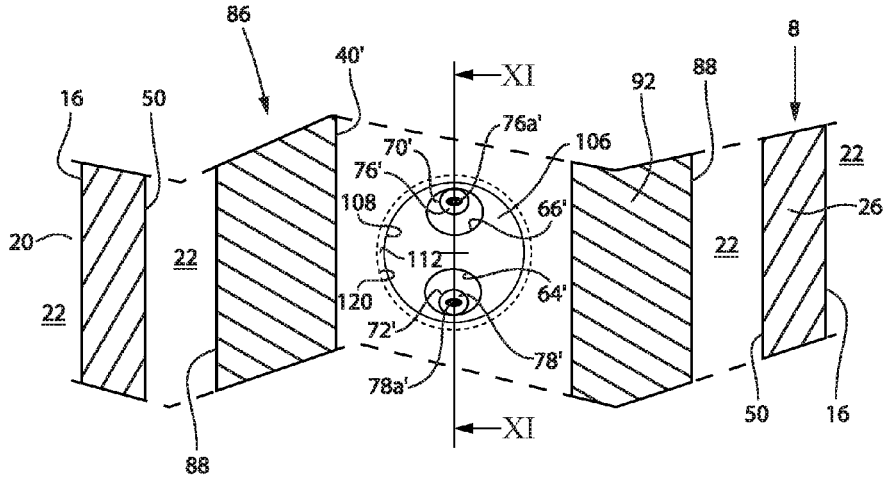
Figure 11:
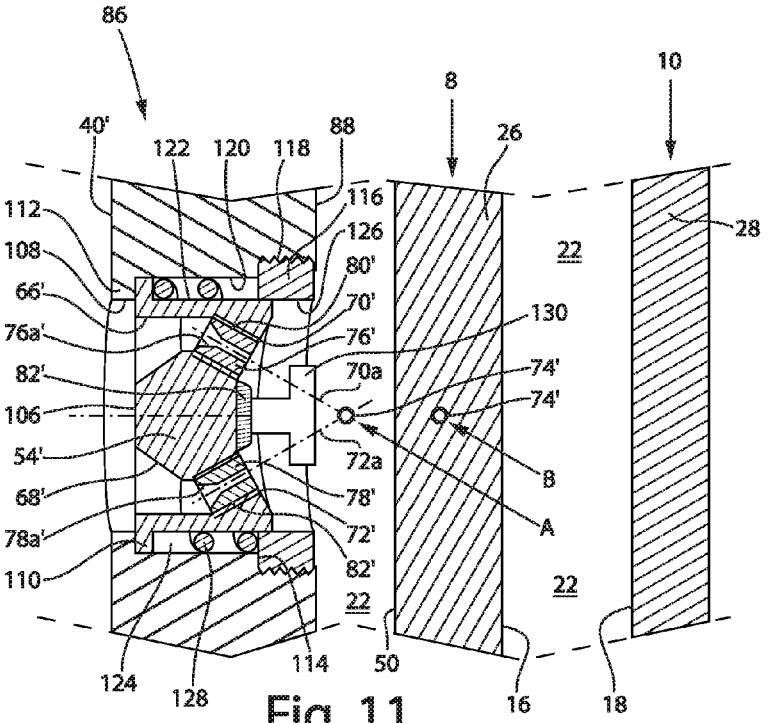
Figure 12:
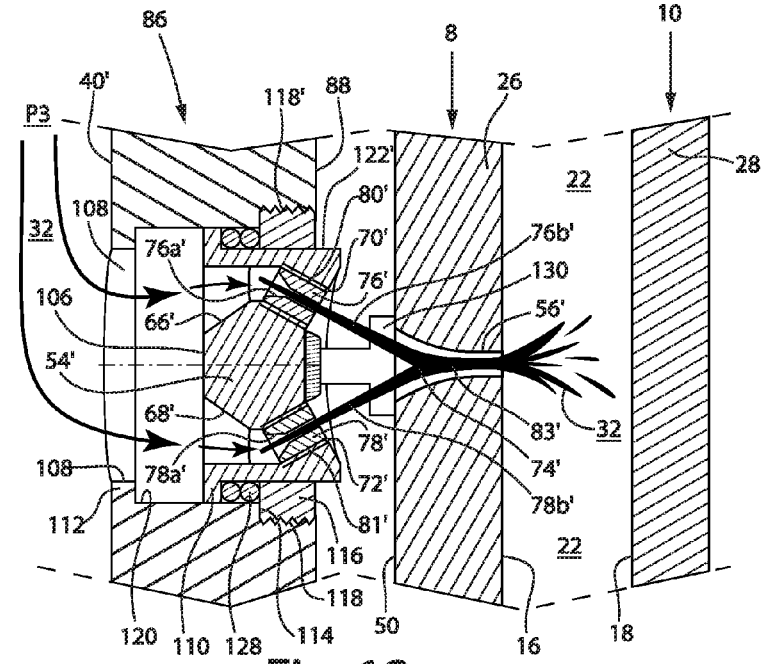
Figure 13:
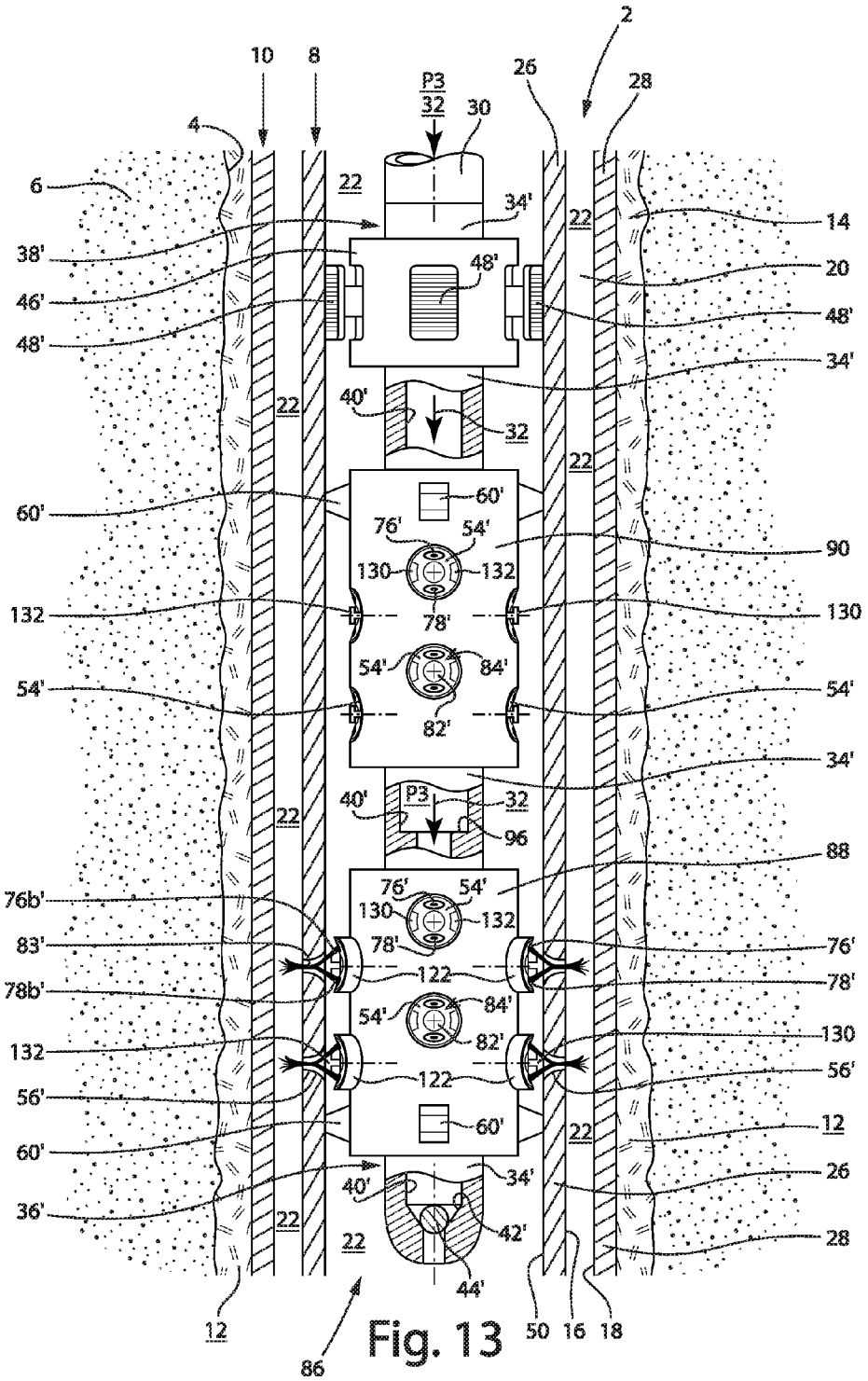
Figure 14:
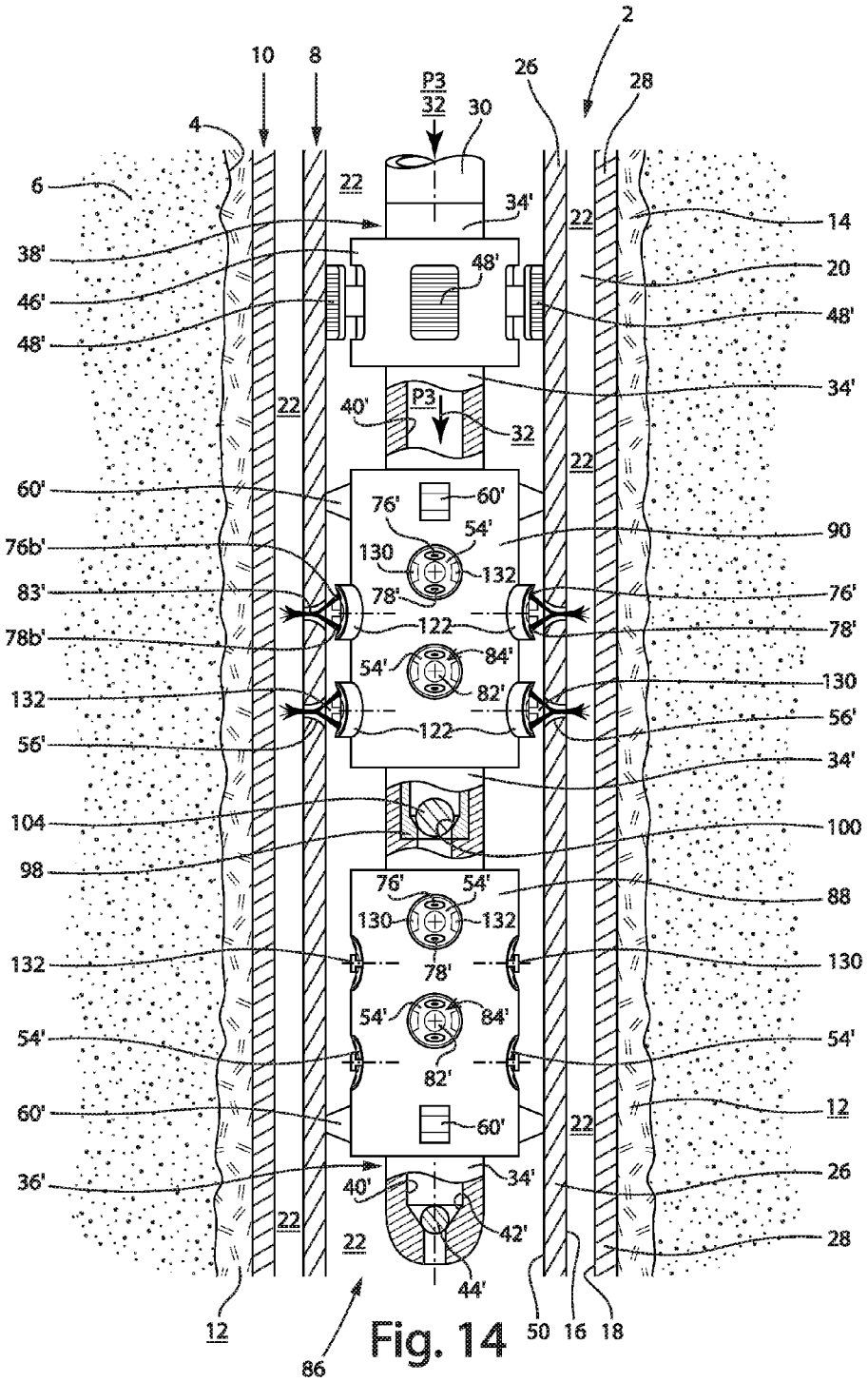
Figure 15:
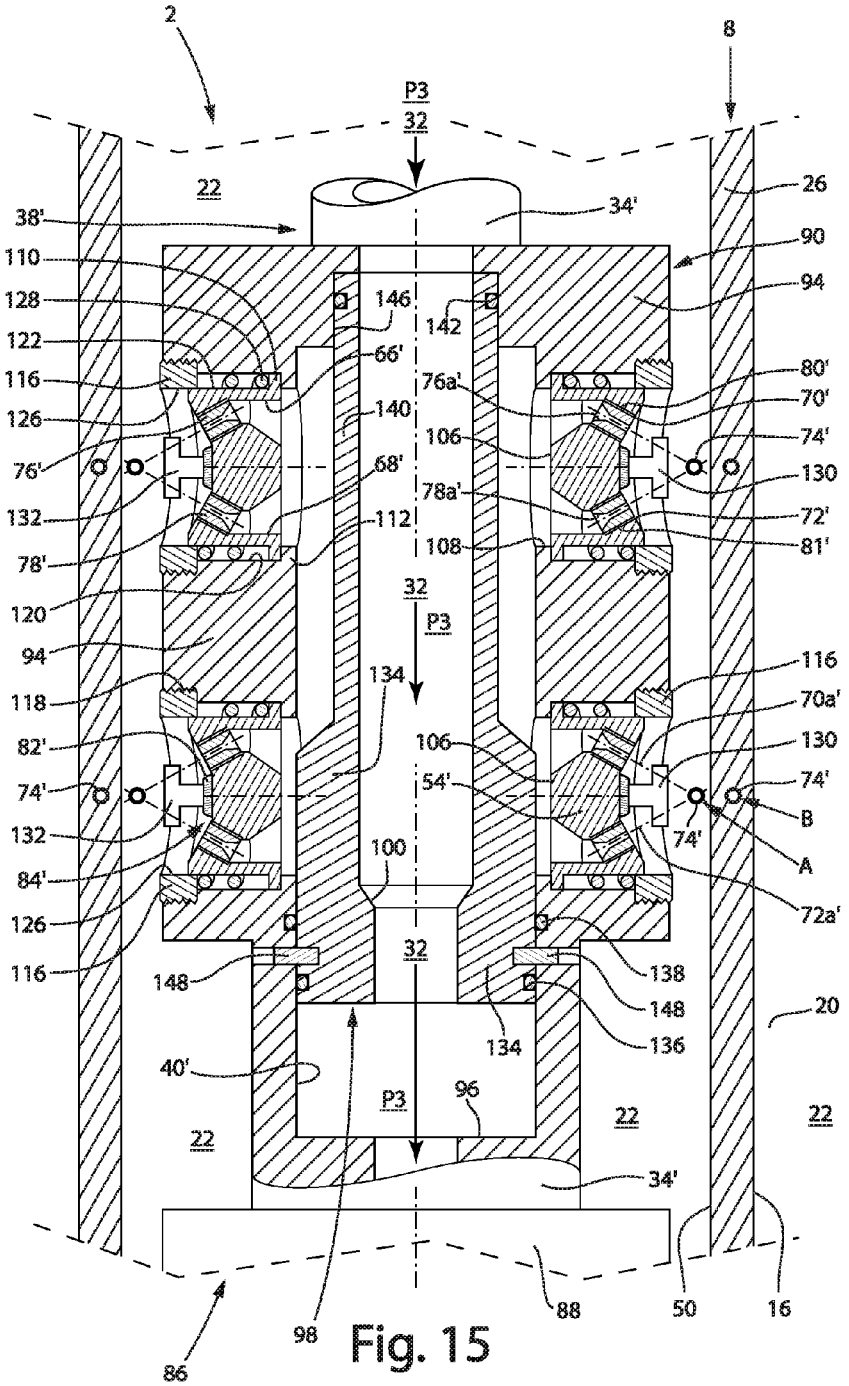
Figure 16:
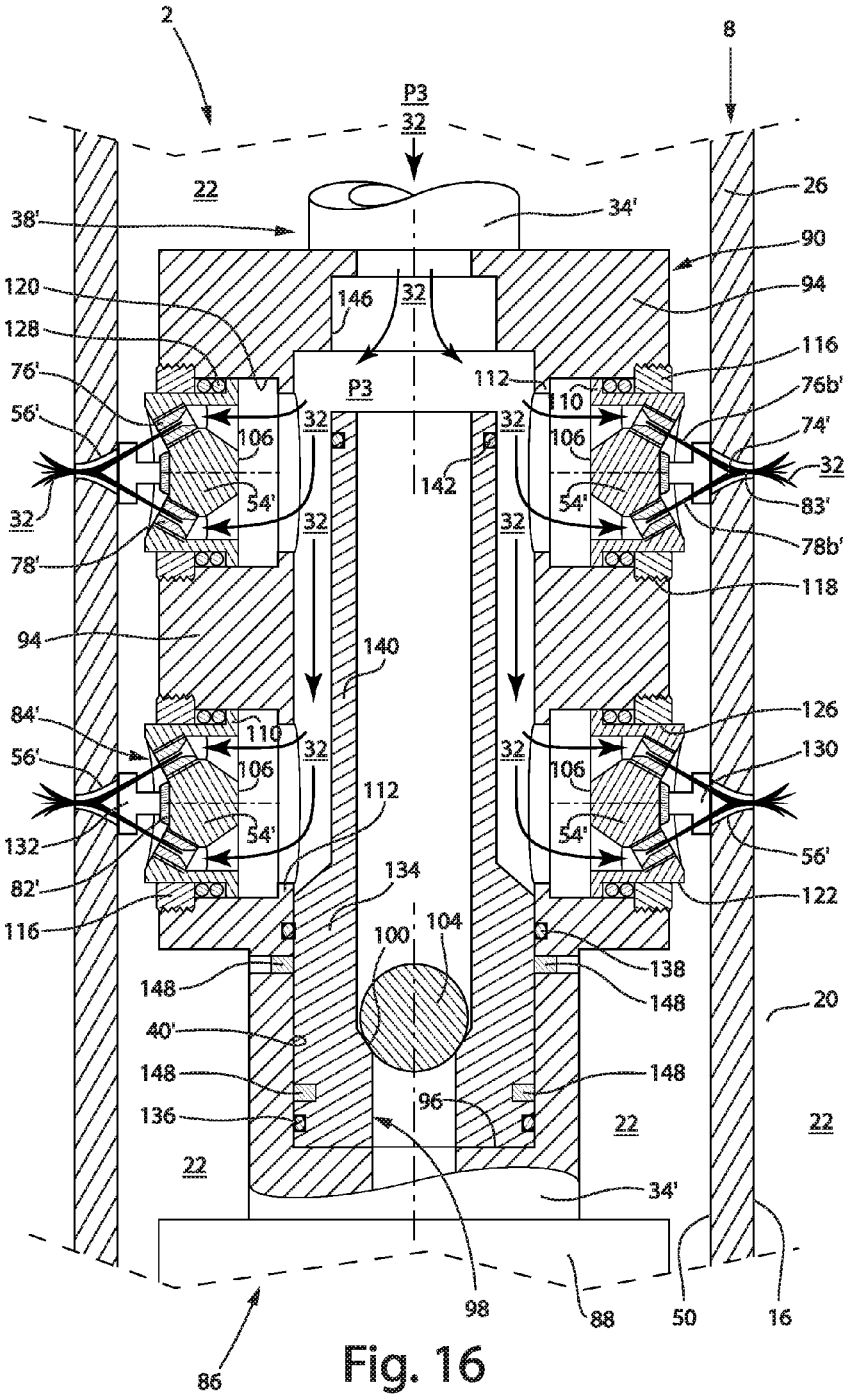
Figure 17:
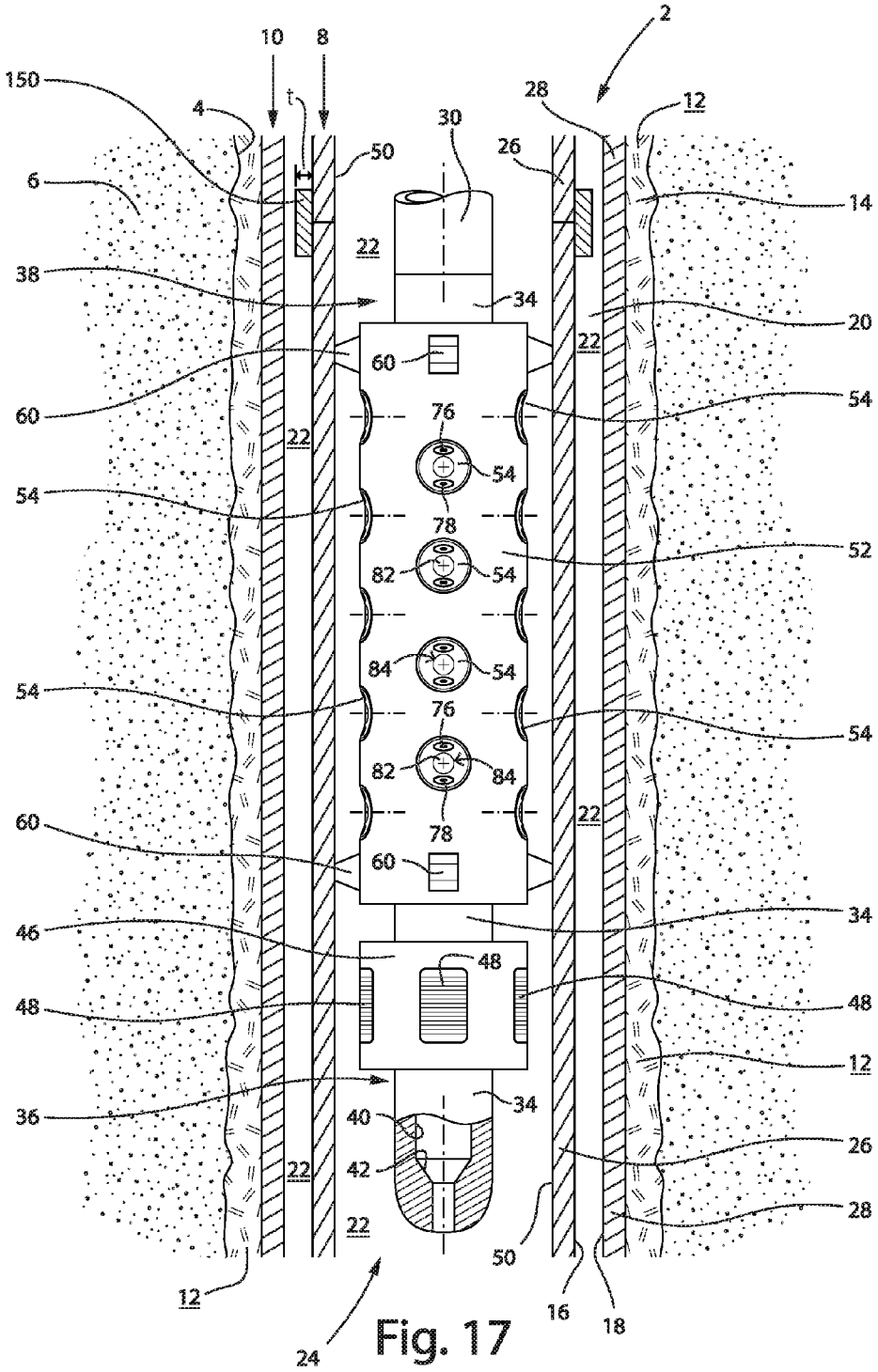
Figure 18:
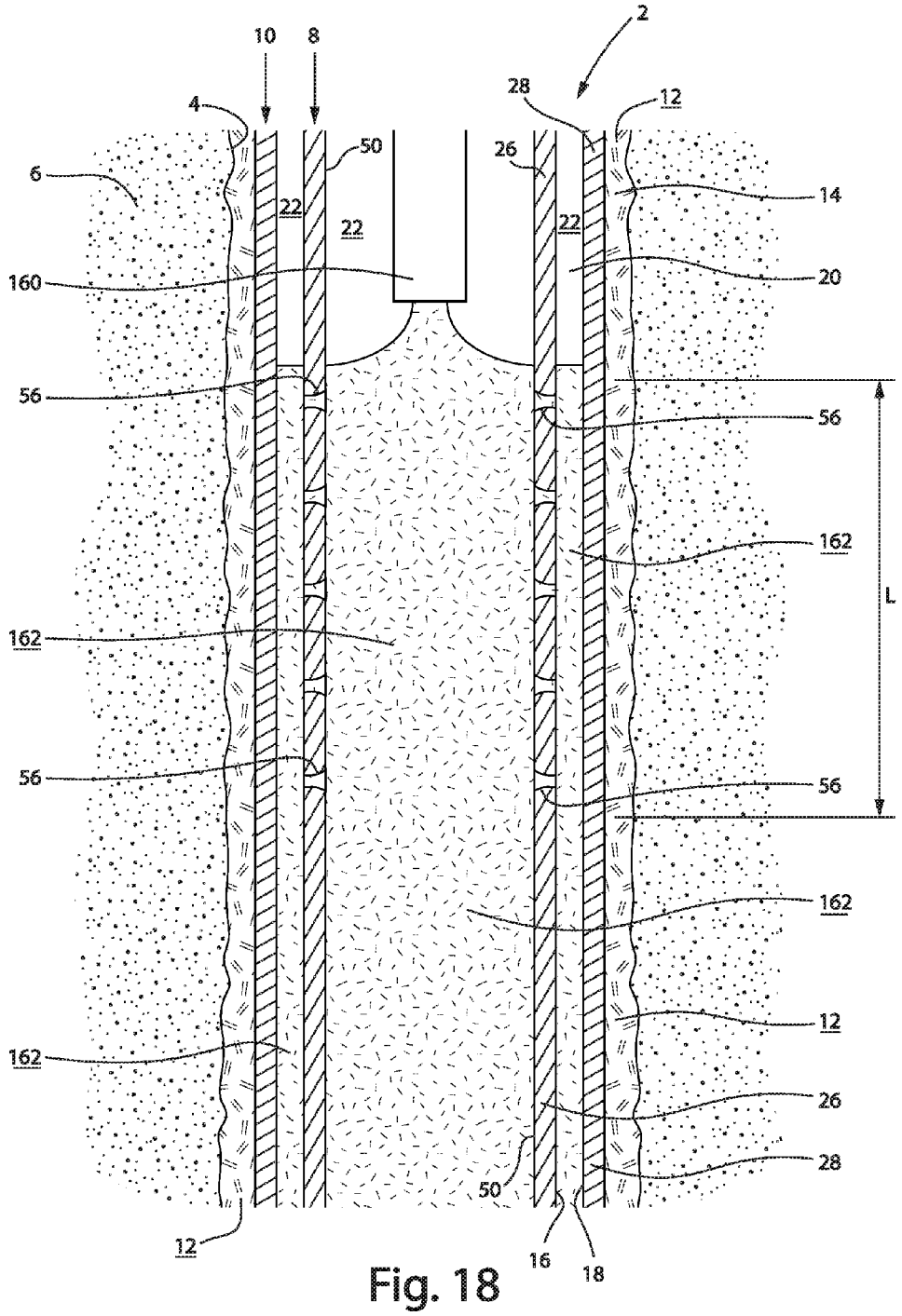

Said figures show the following details:

FIG. 1 shows a front elevation, in partial section, of the first hydraulic cutting tool disposed at a cutting place in a first casing enclosed by a second and larger casing in said petroleum well, wherein the first cutting tool comprises an upper cutting section and a lower anchoring section;

FIG. 2 shows an enlarged cutout of FIG. 1 showing several stationary and replaceable fluid discharge bodies as viewed from the outside of said cutting section, wherein the figure also shows a vertical section line IV-IV;

FIG. 3 shows an enlarged cutout of a stationary fluid discharge body according to FIG. 2 as viewed from the inside of the cutting section, wherein also this figure shows said vertical section line IV-IV;

FIG. 4 shows an enlarged cross section through a stationary fluid discharge body as viewed along section line IV-IV depicted in FIGS. 2 and 3, wherein the figure also shows the fluid discharge body during hydraulic cutting through the pipe wall of the first casing;

FIG. 5 shows a front elevation, in partial section, of the first hydraulic cutting tool during hydraulic cutting through the pipe wall of the first casing at said cutting place in the well, wherein the cutting tool is shown anchored in the first casing by means of said lower anchoring section, and wherein the figure also shows a horizontal section line VI-VI;

FIG. 6 shows an enlarged plan view, in section, as viewed along section line VI-VI depicted in FIG. 5, wherein the figure also shows a vertical section line VII-VII;

FIG. 7 shows an enlarged front elevation, in section, as viewed along section line VI-VI depicted in FIG. 6, wherein the figure shows flow of an abrasive fluid through several stationary fluid discharge bodies during hydraulic cutting through the pipe wall of the first casing;

FIG. 8 shows a front elevation, in partial section, of said second hydraulic cutting tool disposed at a cutting place in the first casing, wherein the second cutting tool comprises an upper anchoring section and two underlying cutting sections, i.e. a first (lower) cutting section and a second (upper) cutting section;

FIG. 9 shows an enlarged cutout of FIG. 8 depicting several radially movable and replaceable fluid discharge bodies as viewed from the outside of such a cutting section, wherein the figure also shows a vertical section line XI-XI;

FIG. 10 shows an enlarged cutout of a radially movable fluid discharge body according to FIG. 9 as viewed from the inside of such a cutting section, wherein also this figure shows said vertical section line XI-XI;

FIG. 11 shows an enlarged cross section through a radially movable fluid discharge body as viewed along section line XI-XI depicted in FIGS. 9 and 10, wherein the figure shows the fluid discharge body in a retracted rest position in such a cutting section;

FIG. 12 shows the radially movable fluid discharge body according to FIG. 11 in a radially extended cutting position during hydraulic cutting through the pipe wall of the first casing;

FIG. 13 shows a front elevation, in partial section, of the second hydraulic cutting tool during hydraulic cutting through the pipe wall of the first casing at said cutting place, wherein the cutting is carried out by means of the first (lower) cutting section in the cutting tool, and wherein the cutting tool is shown anchored in the first casing by means of said upper anchoring section;

FIG. 14 shows the cutting tool according to FIG. 13 upon having replaced said first (lower) cutting section with a second (upper) cutting section in the cutting tool, wherein the cutting now is carried out by means of the second cutting section at another cutting place in the well;

FIG. 15 shows a front elevation, in partial section, of said second cutting section before being activated and replacing the first cutting section in the cutting tool, wherein all radially movable fluid discharge bodies are shown in a retracted rest position when, simultaneously, an internal sleeve is preventing flow of the abrasive fluid onto the fluid discharge bodies in the second (upper) cutting section, and wherein the figure also shows such a fluid flow through said sleeve and further onto the first (lower) cutting section;

FIG. 16 shows the second (upper) cutting section according to FIG. 15 after activation and displacement of said internal sleeve downwards until pressure-isolation against a ring-shaped receiving seat in the cutting tool, whereby the first cutting section is isolated when, simultaneously, fluid flow paths are being opened between the sleeve and all radially movable fluid discharge bodies in the second cutting section, wherein the figure also shows the latter fluid discharge bodies in their radially extended cutting positions during hydraulic cutting through the pipe wall of the first casing;

FIG. 17 shows the first casing according to FIG. 1 provided with a pipe collar for connecting two consecutive pipe lengths of the first casing; and FIG. 18 shows the steps of pumping and placing a fluidized plugging material in the first casing, hence also in a first annulus located between the first and second casings via holes formed through the pipe wall of the first casing.

The figures are schematic and merely show features, details and equipment being essential to the understanding of the invention. Further, the figures are distorted with respect to relative dimensions of elements and details depicted in the figures. The figures are also depicted in a somewhat simplified manner with respect to the shape and richness of detail of such elements and details. Hereinafter, equal, equivalent or corresponding details in the figures will be given substantially the same reference numerals.

DESCRIPTION OF THE EXEMPLARY EMBODIMENTS

FIG. 1 shows a portion of a petroleum well 2 formed by drilling a borehole 4 down through subterranean rocks 6, whereupon a first casing 8 and a second casing 10 have been fixed in the well 2. The second casing 10 encloses the first casing 8 and has been fixed to the subterranean rocks 6 by means of cement 12 placed in a second annulus 14 located between the casing 10 and the rocks 6. The first and smaller casing 8 has been fixed in a corresponding manner at a deeper location in the well 2 (not shown in the figure). Between an outside 16 of the first casing 8 and an inside 18 of the second casing 10, a first annulus 20 is located containing a suitable well fluid 22, for example drilling mud containing possible residual cement (not shown) from a deeper interval in the annulus 20. The first casing 8 is also filled with such a well fluid 22, for example drilling mud (but without residual cement).

FIG. 1 also shows a first hydraulic cutting tool 24 according to the invention disposed in the first casing 8 at a cutting place in the well 2. The object of the cutting tool 24 is to carry out controlled hydraulic cutting of several successive holes (perforations) along a longitudinal section of the well 2, and through a pipe wall 26 of the first casing 8 without simultaneously cutting through a pipe wall 28 of the surrounding second casing 10. In the figure, the first cutting tool 24 is also shown connected to a lower end of a flow-through pipe string 30 extending up to the surface of the well 2 for remote supply of an abrasive fluid 32 (not shown in FIG. 1) from an abrasive fluid source located at the surface (not shown).

The first cutting tool 24 comprises a mandrel 34 having a first (lower) end 36, a second (upper) end 38, and an internal flow channel in the form of a central pipe bore 40 extending between the first end 36 and the second end 38 of the mandrel 34. Thereby, the mandrel 34 is structured for throughput. A ring-shaped receiving seat 42 forming a through opening, and being disposed around the pipe bore 40 in the mandrel 34, is also disposed at this first end 36. By so doing, it is possible to allow flow through the cutting tool 24 during insertion into the well 2, and to close off the pipe bore 40 before activation of the cutting tool 24 and initiation of said hydraulic cutting. The closing of the pipe bore 40 is carried out by dropping an associated plug body, here a ball 44 (see FIG. 5), from the surface and down through the pipe string 30 and the pipe bore 40 in order to be received in a sealing manner in the receiving seat 42 therein; cf. the above discussion thereof.

The first cutting tool 24 also comprises a lower anchoring section 46 provided with several hydraulically activated and radially movable slip segments 48 (having external teeth) distributed around the anchoring section 46. FIG. 1 shows the slip segments 48 in a retracted rest position, whereas FIG. 5 shows the slip segments 48 after activation and in a radially extended gripping position in which they are forced in an anchoring manner against an inside 50 of the first casing 8. In this embodiment, the slip segments 48 are activated and moved radially outwards upon supplying said abrasive fluid 32 to the anchoring section 46 at a specific activation pressure P1, for example 35 bars above the hydrostatic pressure at the existing cutting depth in the well 2. Upon engagement with the inside 50 of the first casing 8, the pipe string 30 and the cutting tool 24 are pulled upwards using a specific pulling force ensuring, via a mechanical force transmission arrangement (not shown) in the anchoring section 46, that the slip segments 48 are forced in an anchoring manner against the inside 50 of the first casing 8. This mechanical force transmission arrangement represents well-known technology and is therefore not discussed in any further detail herein. By means of this force transmission arrangement, the slip segments 48 may also be released from the inside 50 of the first casing 8 upon first bleeding off said activation pressure P1 and then pushing the pipe string 30 and the cutting tool 24 downwards using a specific pushing force ensuring that the slip segments 48 are pulled radially inwards towards said rest position in the anchoring section 46. In this manner, the cutting tool 24 may be anchored and released repeatedly in the casing 8. By so doing, the cutting tool 24 may also be moved within the casing 8 and carry out hydraulic cutting at several different cutting places (longitudinal sections) in the well 2.

Further, and in this embodiment, the first cutting tool 24 comprises only one upper cutting section 52 provided with several stationary and replaceable fluid discharge bodies 54 distributed in a predetermined pattern around the cutting section 52. During hydraulic cutting, the fluid discharge bodies 54 will therefore form a corresponding predetermined pattern of holes 56 through the pipe wall 26 of the first casing 8 (see FIG. 5). Along the cutting section 52, the pipe wall 58 of the mandrel 34 is thickened so as to create enough space for incorporation of the fluid discharge bodies 54 in the pipe wall 58. In this embodiment, an upper and lower portion of the cutting section 52 is provided with external stabilizers 60 (or similar centering devices) for achieving a best possible centered placement of the mandrel 34 in the casing 8. This ensures that all fluid discharge bodies 54 are kept at a best possible equal radial distance from the inside 50 of the first casing 8 during hydraulic cutting through the pipe wall 26 thereof.

Yet further, FIG. 2 shows an enlarged cutout, as viewed from the outside of the cutting section 52, of some of the stationary fluid discharge bodies 54 depicted in FIG. 1. FIG. 3 shows such a fluid discharge body 54, as viewed from the inside of the cutting section 52, whereas FIG. 4 shows an enlarged cross section through such a fluid discharge body 54, as viewed along section line IV-IV depicted in FIGS. 2 and 3, during hydraulic cutting through the pipe wall 26 of the first casing 8. Each fluid discharge body 54 also comprises at least one suitably placed packer element (not shown) for sealing in and/or around the fluid discharge body 54. In order to avoid overloading the figures with an unnecessary richness of detail, such packer elements and possible other more specific details of the cutting tool 24 are not shown in the figures. As mentioned initially, the figures only show features, details and equipment being essential to the understanding of the invention.

FIGS. 2-4 also show that each stationary fluid discharge body 54 in this embodiment is shaped as a cylindrical body releasably screwed, via a threaded connection 62, into a corresponding bore 64 through the pipe wall 58 of the mandrel 34. By so doing, each fluid discharge body 54 may be replaced when required. Each fluid discharge body 54 comprises two graduated (stepped) fluid supply channels 66, 68 connected, at the upstream side, in a flow communicating manner to the central pipe bore 40 in the mandrel 34 for supply of the abrasive fluid 32, and also connected, at the downstream side, in a flow communicating manner to respective, oblique discharge bores 70, 72 having respective non-parallel discharge directions 70*a*, 72*a* directed at a common intersection point 74 located outside the fluid discharge body 54. In this example, and when the cutting tool 24 is centered in the casing 8 by means of said stabilizers 60, the intersection point 74 for each fluid discharge body 54 will be located approximately midway in the pipe wall 26 of the first casing 8, as shown in FIG. 2. Further, each discharge bore 70, 72 is provided with a respective cylindrical and replaceable nozzle insert 76, 78 releasably screwed into the discharge bore 70, 72 via a corresponding threaded connection 80, 81. Each nozzle insert 76, 78 has a respective bore/discharge opening 76*a*, 78*a* formed with a substantially smaller flow cross sectional area than that of the flow cross sectional area in the respective fluid supply channel 66, 68 (and discharge bore 70, 72). Upon pumping the abrasive fluid 32 through the fluid discharge body 54 and its nozzle inserts 76, 78, cutting jets 76*b*, 78*b* of the abrasive fluid 32 will discharge at high velocity from the respective discharge openings 76*a*, 78*a* in the nozzle inserts 76, 78 and then cut into and through the pipe wall 26 of the first casing 8. By so doing, a through hole 56 is formed in the pipe wall 26. Insofar as the abrasive cutting jets 76*b*, 78*b* meet and are weakened in the intersection point 74 in the pipe wall 26, the further cutting through the pipe wall 26 is carried out by a common and substantially weakened cutting jet 83, which eventually discharges and is dispersed at a substantially lower flow velocity in the first annulus 20 between the first and second casing 8, 10. This prevents or limits any damage to the pipe wall 28 of the second casing 10. This course of flow is shown in FIGS. 4-7, where downstream-directed arrows in the figures indicate the flow direction of the abrasive fluid 32.

Otherwise, the abrasive fluid 32 is supplied at a specific cutting pressure P3 forming cutting jets 76*b*, 78*b* having a sufficiently high discharge velocity for allowing them to cut effectively through said pipe wall 28. After collision of the cutting jets in said intersection point 74 in the pipe wall 26, this cutting pressure P3 must also be suitable for providing said common and weakened cutting jet 83 with a sufficiently low flow velocity in order not to cause perforation or substantial damage to the pipe wall 28 of the second casing 10. A cutting pressure P3 being suitable in this context may be in the order of 80-135 bars beyond the hydrostatic pressure at the existing cutting depth in the well 2. The cutting pressure P3, however, must be adapted to the type and properties, and especially the density, of the abrasive fluid 32 being used in the particular case. The pumping of the abrasive fluid 32 down through the pipe string 30 and the mandrel 34 and further out through all fluid discharge bodies 54 is terminated after a predetermined period of time corresponding to, as a minimum, the time required to cut the corresponding holes 56 through the pipe wall 26 of the first casing 8. In this case, said period of time has been determined via prior tests simulating the conditions, equipment and materials present in the well 2.

Further, FIGS. 5-7 show the first hydraulic cutting tool 24 whilst the abrasive fluid 34 is being pumped therethrough and is cutting holes 56 through said pipe wall 26. In this cutting mode, FIG. 5 also shows said ball 44 placed in a sealing manner in the receiving seat 42 whilst said slip segments 48 are anchored against the inside 50 of the first casing 8. FIGS. 6 and 7 also show various sections through the cutting tool 24 according to FIG. 5.

Finally, it is mentioned that each fluid discharge body 54 in this embodiment also comprises a releasable insert (or pillow) 82 of a shock absorbing material, such as an elastomer material or similar, disposed within a backsplash area 84 between the nozzle inserts 76, 78. The shock absorbing insert (or pillow) 82 provides for dampening of the impact and wear of the abrasive fluid 32 on the fluid discharge body 54 when the fluid 32 splashes back towards the fluid discharge body 54 during the hydraulic cutting of the first casing 8. Other exposed areas on or in the mandrel 34, such as other areas of the fluid discharge body 54 and possible other areas located around and between the fluid discharge bodies 54 shown, may also be provided with such a shock absorbing material in order to prevent or reduce the wear on such exposed areas (not shown in the figures).

Reference is now made to FIGS. 8-16 showing an embodiment of a second hydraulic cutting tool 86 according to the invention. FIGS. 8-16 show the same well configuration as shown in context of the preceding exemplary embodiment of the invention. Further, the second cutting tool 86 has a number of components in common with the preceding first cutting tool 24. Hereinafter, such components will therefore be denoted with substantially the same or similar reference numerals. The second cutting tool 86 also operates according to the same hydraulic cutting principles as those of the first cutting tool 24. Accordingly, the course of flow through the cutting tool, and also the cutting action of the abrasive fluid 32, essentially will be equal in both cutting tools 24, 86.

Further, FIG. 8 shows the second cutting tool 86 when connected to a lower end of said pipe string 30 and disposed in the first casing 8 at a cutting place in the petroleum well 2. The second cutting tool 86 comprises, as mentioned, an upper anchoring section 46' and two underlying and successive cutting sections, i.e. a first (lower) cutting section 88 and a second (upper) cutting section 90. For example, the second cutting section 90 may be used as a replacement for the first cutting section 88 when fluid discharge bodies 54 in the first cutting section 88 are worn out, or when other types of fluid discharge bodies are to be used.

Unlike the cutting section 52 according to the previous embodiment, each cut section 88, 90 in the present embodiment is provided with several radially movable and replaceable fluid discharge bodies 54' distributed in a predetermined pattern around the cut section 88, 90. During hydraulic cutting, the fluid discharge bodies 54' in each cutting section 88, 90 will therefore form a corresponding predetermined pattern of holes 56' through the pipe wall 26 of the first casing 8 (see FIGS. 13 and 14). In practice, the actual number of fluid discharge bodies 54' in each such cutting section 88, 90 may be different (more or less) from the number shown schematically in the figures according to this embodiment.

Also the second cutting tool 86 comprises a flow-through mandrel 34' having a first (lower) end 36', a second (upper) end 38', and a central pipe bore 40' disposed between the ends 36', 38'. Along the first cutting section 88 and the second cutting section 90, the respective pipe walls 92, 94 of the mandrel 34' are thickened so as to create enough space for incorporation of the radially movable fluid discharge bodies 54' in the respective pipe walls 92, 94. Also in this embodiment, a ring-shaped receiving seat 42' having a through opening is disposed at the first end 38' of the mandrel 34'. The receiving seat 42' is structured for sealing reception of a ball 44', which is dropped down from the surface (see FIG. 13). Thus, the receiving seat 42' has the same function and effect as that of the receiving seat 42 in the first cutting tool 24 (see FIG. 5).

A ring-shaped receiving seat 96 having a through opening is also disposed in an area of the mandrel 34' located below the fluid discharge bodies 54' in the second cutting section 90, and around the pipe bore 40'. This opening in the receiving seat 96 must necessarily be somewhat larger than the opening in the receiving seat 42' to allow for passage of the preceding ball 44'. The receiving seat 96 is structured for reception of an axially movable, internal sleeve 98 located within the pipe bore 40' in the second cutting section 90. At the lower end thereof, the sleeve 98 is provided with an internal, ring-shaped receiving seat 100 having a through opening. The receiving seat 100 is structured for sealing reception of a (upper) ball 104, which is dropped down from the surface (see FIG. 14). Also the opening in the receiving seat 100 must be somewhat larger than the opening in the receiving seat 42' to allow for passage of the preceding ball 44'. For this reason, the upper ball 104 is somewhat larger than the lower ball 44'. This will be discussed in further detail hereinafter, and in context of FIGS. 15 and 16.

In this embodiment, also an upper portion of the cutting section 88 and a lower portion of the cutting section 90 are provided with external stabilizers 60' (or similar centering devices) for achieving a best possible centered placement of the mandrel 34' in the casing 8.

Yet further, the upper anchoring section 46' is provided with several hydraulically activated and radially movable slip segments 48' (having external teeth) distributed around the anchoring section 46'. The slip segments 48' have the same structure and mode of operation as that of the slip segments 48 in the first cutting tool 24 and are therefore not discussed in further detail herein. Insofar as the slip segments 48' are activated through supply of said abrasive fluid 32 at a specific activation pressure P1, and insofar as the flow of the abrasive fluid 32 through the pipe bore 40' is closed off upon having received the ball 104 in a sealing manner in the receiving seat 100 in said sleeve 98, the anchoring section 46' must necessarily be placed above the cutting sections 88, 90. This ensures fluid supply to the slip segments 48' independent of which cutting section 88, 90 is being used for the hydraulic cutting. By so doing, it is also possible to anchor and release the second cutting tool 86 repeatedly, whereby the cutting tool 86 may be moved within the first casing 8 and carry out hydraulic cutting at several different cutting places in the well 2.

FIGS. 13 and 14 therefore show the upper anchoring section 46' anchored in the casing 8 at two different cutting places in the well 2. In FIG. 13, the hydraulic cutting is carried out by means of the first (lower) cutting section 88 in the cutting tool 86, and upon having received said (lower) ball 44' in a sealing manner in the receiving seat 42'. In FIG. 14, however, the hydraulic cutting is carried out by means of the second (upper) cutting section 90 upon having received said upper and larger ball 104 in a sealing manner in the receiving seat 100 in said sleeve 98. The course of flow within and outside the second cutting tool 86 is depicted in FIGS. 12-16, where downstream-directed arrows in the figures indicate the flow direction of the abrasive fluid 32.

Further, FIG. 9 shows an enlarged cutout, as viewed from the outside of such a cutting section 88, 90, of some of the radially movable fluid discharge bodies 54' depicted in FIG. 8. FIG. 10 shows such a fluid discharge body 54', as viewed from the inside of such a cutting section 88, 90, whereas FIGS. 11 and 12 show an enlarged cross section through such a fluid discharge body 54', as viewed along section line XI-XI depicted in FIGS. 9 and 10. FIG. 11 shows the fluid discharge body 54' in a retracted rest position in such a cutting section 88, 90, whereas FIG. 12 shows the fluid discharge body 54' in a radially extended cutting position during hydraulic cutting through the pipe wall 26 of the first casing 8. Also herein, each fluid discharge body 54' comprises at least one suitably placed packer element (not shown) for sealing in and/or around the fluid discharge body 54'. In order to avoid overloading the figures with an unnecessary richness of detail, such packer elements and possible other and more specific details of the cutting tool 86 are not shown in the figures.

FIGS. 9-12 also show, in resemblance with the stationary and replaceable fluid discharge body 54 according to the previous embodiment, that each radially movable and replaceable fluid discharge body 54' in this embodiment is formed as a cylindrical body having graduated (stepped) fluid supply channels 66', 68'; oblique discharge bores 70', 72' having respective non-parallel discharge directions 70*a*', 72*a*' directed at a common intersection point 74' located outside the fluid discharge body 54'; cylindrical and replaceable nozzle inserts 76', 78' releasably screwed into the respective discharge bores 70', 72' via corresponding threaded connections 80', 81'; and also a releasable insert (or pillow) 82' of a shock absorbing material disposed within a backsplash area 84' located between the nozzle inserts 76', 78'. Each nozzle insert 76', 78' also has a respective bore/discharge opening 76*a*', 78*a*' formed with a substantially smaller flow cross sectional area than that of the flow cross sectional area in the respective fluid supply channel 66', 68' (and discharge bore 70', 72'). Upon pumping the abrasive fluid 32 through the fluid discharge body 54' and its nozzle inserts 76', 78', cutting jets 76*b*', 78*b*' of the abrasive fluid 32 will discharge at high velocity from the respective discharge openings 76*a*', 78*a*' in the nozzle inserts 76', 78' and then cut through the pipe wall 26 of the first casing 8. A common cutting jet 83' finally discharges in the first annulus 20 and is dispersed at a substantially lower flow velocity, as described in context of the previous embodiment.

When the fluid discharge body 54' is in its retracted rest position, as shown in FIG. 11, said common intersection point 74' will be located in a position A located between the fluid discharge body 54' and the inside 50 of the casing 8. However, when the fluid discharge body 54' is in its radially extended cutting position, as shown in FIG. 12, the intersection point 74' (in this embodiment) will be located in a position B located approximately midway in the pipe wall 26 of the casing 8. Position A and B for several fluid discharge bodies 54' is also shown in FIG. 15.

Moreover, each radially movable fluid discharge body 54' is formed as a piston, the upstream end portion of which constitutes a pressure-sensitive piston surface 106. The fluid discharge body 54' is disposed in a graduated (stepped) bore 108 through the pipe wall 92, 94 of the mandrel 34'. At the upstream end thereof, the fluid discharge body 54' is provided with a ring-shaped collar 110 bearing, when in said rest position, against a ring-shaped first ledge 112 formed in the pipe wall 92, 94 at an upstream portion of the graduated bore 108. Further, a ring-shaped second ledge 114 is formed in the pipe wall 92, 94 at a downstream portion of the bore 108. At this downstream portion, the bore 108 is also provided with a sleeve ring 116 releasably screwed, via a threaded connection 118, into the bore 108 and bearing against said second ledge 114. Upon unscrewing and removing the sleeve ring 116, the fluid discharge body 54' may be replaced when required. Yet further, the collar 110 of the fluid discharge body 54' is disposed in a slidable and radially movable manner against and along a smooth portion 120 of the graduated bore 108. This smooth portion 120 is located between said first ledge 112 and the sleeve ring 116 and defines, together with an outside 122 of the fluid discharge body 54', an internal annulus 124. In addition, the outside 122 of the fluid discharge body 54' is disposed in a slidable and radially movable manner against and along a smooth inside 126 of the sleeve ring 116. In this manner, the fluid discharge body 54' may be moved back and forth in the radial direction, and between a retracted rest position (see FIGS. 11 and 15) and a radially extended cutting position (see FIGS. 12 and 16). In order to allow each fluid discharge body 54' to move from its extended cutting position and back into its retracted rest position, the fluid discharge body 54' is also provided with an external coil spring 128 having suitable properties of resilience. The coil spring 128 is disposed in said internal annulus 124 located between the first ledge 112 and the sleeve ring 116.

In order to be able to activate and move the fluid discharge body 54' radially outwards, the abrasive fluid 32 must be supplied to said piston surface 106 (on the fluid discharge body 54') at a specific activation pressure P2 overcoming the spring resistance in the coil spring 128. This activation pressure P2, however, must be higher than the activation pressure P1 for said slip segments 48' in the anchoring section 46', and less than said cutting pressure P3 for the hydraulic cutting. This activation pressure P2 may thus be in the order of 60-70 bars beyond the hydrostatic pressure at the existing cutting depth in the well 2. Upon exposing the piston surface 106 to such a movement-activating fluid pressure P2, the collar 110 of the fluid discharge body 54' is moved radially outwards and forces the coil spring 114 against the sleeve ring 116, as shown in FIGS. 12 and 16. In this position, the coil spring 128 is biased against the sleeve ring 116. Thereafter, the fluid pressure may be increased to said cutting pressure P3 (for example 80-135 bars), which initiates the subsequent hydraulic cutting through the pipe wall 26 of the first casing 8. Upon having completed the hydraulic cutting and lowering the fluid pressure to below said activation pressure P2, the biasing of the coil spring 128 will be released and will ensure that the fluid discharge body 54' returns to its rest position in the pipe wall 92, 94 of the mandrel 34'. This course of action applies to all fluid discharge bodies 54' in the particular one of the cutting sections 88, 90 being active.

In this embodiment, each radially movable fluid discharge body 54' is also provided with two spacer elements 130, 132 of a specific length extending radially outwards from each fluid discharge body 54' and being disposed diametrically opposite of each other on the outside of the fluid discharge body 54' (see FIG. 9). The spacer elements 130, 132 are structured in a manner allowing them to keep the bores/discharge openings 76*a*', 78*a*' in said nozzle inserts 76', 78' at a specific radial distance from the inside 50 (and the pipe wall 26) of the first casing 8 when the fluid discharge body 54' is located in its radially extended cutting position. Further, each spacer element 130, 132 is releasably connected to the fluid discharge body 54', thereby allowing it to be replaced with another spacer element in context of wear or change of said radial length. At the outer surface thereof, each spacer element 130, 132 may also have a shape adapted to the internal pipe curvature of the first casing 8. Thereby, the spacer elements 130, 132 are self-centering when bearing against the casing 8. Use of such spacer elements 130, 132 or similar spacer devices may prove particularly useful in a non-vertical well 2, such as a deviation well or a horizontal well. Due to the slope of such a well 2, the cutting tool 86 may assume a somewhat eccentric placement in the first casing 8, and even though the cutting tool 86 is provided with said external stabilizers 60'. In such a situation, the spacer elements 130, 132 will ensure that each fluid discharge body 54' is positioned at substantially the same radial distance from the casing 8 when the fluid discharge body 54' is located in its radially extended cutting position. This ensures that the hydraulic cutting of holes 56' through the pipe wall 26 of the casing 8 is carried out as uniformly as possible.

Reference is now made to FIGS. 15 and 16 illustrating, among other things, the manner in which said second (upper) cutting section 90 is activated and replaces the first (lower) cutting section 88, for example after the first cutting section 88 has been worn out.

FIG. 15 shows the second cutting section 90 in its inactive position whilst the first cutting section 88 is active and being used for hydraulic cutting, as shown in FIG. 13.

Further, FIG. 16 shows the second cutting section 90 in its active position, and during hydraulic cutting, whilst the first cutting section 88 is closed off to fluid supply and is located in an inactive position, as shown in FIG. 14.

Unlike the first cutting section 88, the second cutting section 90 comprises said axially movable, internal sleeve 98 in the pipe bore 40'. In this embodiment, the sleeve 98 comprises a lower, thickened portion 134 bearing sealingly against the pipe bore 40', and within an area underlying the fluid discharge bodies 54' of the cutting section 90. This seal is provided by sealing rings 136, 138 disposed on the outside of the sleeve 98 and in the pipe wall 94 of the mandrel 34', respectively, as shown in the present figures. The sleeve 98 also comprises an upper, narrower portion 140 provided with, at the upper end thereof, an external sealing ring 142. Due to this upper, narrower portion 140, a flow annulus 144 is located between the narrower portion 140 and the pipe bore 40' in the second cutting section 90.

FIG. 15 also shows the upper end of the sleeve 124 and the sealing ring 142 disposed in a sealing manner within a graduated, axial bore 146 formed at an upper portion of the pipe bore 40' in the second cutting section 90. Simultaneously, the lower, thickened portion 134 of the sleeve 98 is locked in the pipe bore 40' by means of shear pins 148 connecting the sleeve 98 to the pipe wall 94 in the cutting section 90. The shear pins 148 are disposed below the fluid discharge bodies 54' and between said sealing rings 136, 138. When in this locked position, the sleeve 98 prevents fluid communication between the fluid discharge bodies 54' and the pipe bore 40' in the second cutting section 90. By so doing, the sleeve 98 also seals these fluid discharge bodies 54'. When the sleeve 98 is located in this locked position, the abrasive fluid 32 may be pumped directly through the sleeve 98 and cutting section 90 and further onto the first (lower) cutting section 88 for hydraulic cutting by means of the fluid discharge bodies 54' in the cutting section 88, as shown in FIGS. 13 and 15.

FIG. 16 shows the sleeve 98 after having dropped said (upper) ball 104 down from the surface and having received it in a sealing manner in the receiving seat 100 in the sleeve 98 in the second cutting section 90. Upon subsequently increasing the fluid pressure in the abrasive fluid 32 until said shear pins 148 are severed, the sleeve 98 has moved axially downwards within the pipe bore 40', and onto pressure-isolating engagement with said ring-shaped receiving seat 96 in the pipe bore 40' below the cutting section 90. By so doing, the sleeve 98 has also moved far enough down within the pipe bore 40' for said flow annulus 144 to span all fluid discharge bodies 54' in the cutting section 90, but also far enough down to open fluid flow paths between said axial bore 146 and the flow annulus 144 in the cutting section 90. Thereby, the abrasive fluid 32 may flow onto and through these fluid discharge bodies 54' and may then carry out hydraulic cutting of holes 56' through the pipe wall 26 of the first casing 8.

In another embodiment (not shown), it should be mentioned that the sleeve 98 may be comprised of an axially movable sleeve of a unitary outer diameter spanning the fluid discharge bodies 54' in the second cutting section 90. Following severing of said shear pins 148 and axial movement of such a sleeve towards said receiving seat 96 below the cutting section 90, the sleeve may be moved completely past the fluid discharge bodies 54' in the cutting section 90. By so doing, these fluid discharge bodies 54' enter into direct flow communication with the pipe bore 40' in the second cutting section 90. This, however, requires that the mandrel 34' and the pipe bore 40' below the cutting section 90 are longer than that indicated in FIG. 8 and FIGS. 13-16.

FIG. 17 shows the first casing 8 provided with a pipe collar 150 connecting two consecutive pipe lengths of the first casing 8. For this purpose, the pipe collar 150 is provided with internal threads (not shown) for receiving corresponding external threads (not shown) at adjoining ends of such consecutive pipe lengths of the first casing 8. The pipe collar 150 has a radial thickness 't' suitable for determining, in one embodiment, said minimum radial distance between the outside 16 of the first casing 8 and the inside 18 of the second casing 10. Although generally comprising several such pipe collars 150 for connecting consecutive pipe lengths along the casing string, the first casing 8 of FIG. 17 only shows one such pipe collar 150 for purpose of illustration.

FIG. 18 relates to the claimed method and shows the well 2 after having used the hydraulic cutting tool 24 of FIG. 5 to cut, along a longitudinal section L of the well 2, a number of holes 56 through the pipe wall 26 of the first casing 8, and after having removed the hydraulic cutting tool 24 from the well 2. Further, FIG. 18 shows a pipe string 160, for example a coiled tubing string or a drill pipe string, in the process of pumping and placing a fluidized plugging material 162, such as cement slurry, in the first casing 8 along at least the longitudinal section L of the well 2. By so doing, the fluidized plugging material 162 also flows through the holes 56 in the first casing 8 and onwards into the first annulus 20 located between the first casing 8 and the second casing 10, thereby plugging both the first casing 8 and the first annulus 20 along at least the longitudinal section L of the well 2.

The invention claimed is:

1. A hydraulic cutting tool for hydraulic cutting through a pipe wall of a pipe body, and from internally in the pipe body, wherein the cutting tool comprises a mandrel having the following combination of features:

a first end;

a second end structured in a manner allowing the second end to be connected to a flow-through pipe string for selective remote supply of an abrasive fluid;

an internal flow channel connected in a flow communicating manner to at least said second end;

at least one anchoring section provided each with at least one radially movable gripping element structured for selective activation and anchoring against an inside of the pipe body; and at least one cutting section provided each with outwardly directed discharge openings connected in a flow communicating manner to said internal flow channel for supply of said abrasive fluid, wherein each discharge opening is configured in a manner allowing each discharge opening to form a discharging cutting jet of the abrasive fluid for cutting through the pipe wall, wherein such the at least one cutting section also comprises at least one fluid discharge body;

wherein each such fluid discharge body comprises at least two outwardly directed discharge openings having non-parallel discharge directions directed at a common intersection point located outside the fluid discharge body; and wherein said outwardly directed discharge openings are connected in a flow communicating manner to the internal flow channel in the mandrel;

whereby abrasive cutting jets, which discharge at high velocity from said discharge openings in each fluid discharge body, are structured in a manner allowing them to cut into and through the pipe wall of the pipe body, thus forming at least one hole through the pipe wall; and whereby said abrasive cutting jets also are structured in a manner allowing them to meet and disperse in said intersection point, thus weakening the further cutting ability of the cutting jets.

2. The hydraulic cutting tool according to claim 1, wherein the at least one fluid discharge body is disposed in the pipe wall of the mandrel.

3. The hydraulic cutting tool according to claim 1, wherein the at least one fluid discharge body comprises a shock absorbing material.

4. The hydraulic cutting tool according to claim 1, wherein each outwardly directed discharge opening comprises a nozzle insert configured in a manner allowing the nozzle insert to form said discharging cutting jet of the abrasive fluid.

5. The hydraulic cutting tool according to claim 1, wherein the cutting tool comprises at least one centering device structured in a manner allowing the at least one centering device to position the mandrel in a centered manner in the pipe body.

6. The hydraulic cutting tool according to claim 5, wherein the at least one radially movable gripping element is structured in a manner allowing the at least one radially moveable gripping element to center the mandrel in the pipe body when the gripping element is located in a radially extended anchoring position of the at least one radially gripping element.

7. The hydraulic cutting tool according to claim 5, wherein said centering device comprises at least one stabilizer disposed on the outside of the cutting tool for centered placement of the mandrel in the pipe body.

8. The hydraulic cutting tool according to claim 5, wherein the at least one fluid discharge body is disposed in a stationary manner in the mandrel.

9. The hydraulic cutting tool according to claim 8, wherein the at least one fluid discharge body is releasably disposed in the mandrel.

10. The hydraulic cutting tool according to claim 1, wherein the at least one fluid discharge body is structured in a radially movable manner for selective movement of the fluid discharge body between a retracted rest position and a radially extended cutting position.

11. The hydraulic cutting tool according to claim 10, wherein the at least one radially movable fluid discharge body is releasably disposed in the mandrel.

12. The hydraulic cutting tool according to claim 11, wherein the at least one radially movable fluid discharge body is slidably disposed in a surrounding sleeve body being releasably disposed in the mandrel.

13. The hydraulic cutting tool according to claim 10, wherein the at least one radially movable fluid discharge body comprises a piston surface for outwardly directed radial movement of the fluid discharge body upon supply of a movement-activating fluid pressure (P2) against the piston surface; and wherein the fluid discharge body also is spring-loaded for inwardly directed radial return movement of the fluid discharge body after cessation of the movement-activating fluid pressure (P2) against the piston surface.

14. The hydraulic cutting tool according to claim 10, wherein the at least one radially movable fluid discharge body comprises a spacer device structured in a manner allowing the spacer device to keep outwardly directed discharge openings in the fluid discharge body at a specific radial distance from the inside of the pipe body when the fluid discharge body is located in a radially extended cutting position.

15. The hydraulic cutting tool according to claim 14, wherein the spacer device comprises at least one spacer element of a specific length extending radially outwards from the radially movable fluid discharge body.

16. The hydraulic cutting tool according to claim 10, wherein the cutting tool comprises at least one movement limitation device structured in a manner allowing the at least one movement limitation device to limit the radial movement of the fluid discharge body outwards from the mandrel.

17. The hydraulic cutting tool according to claim 16, wherein the at least one movement limitation device comprises at least one stop device disposed in the radially movable fluid discharge body.

18. The hydraulic cutting tool according to claim 1, wherein at least one cutting section in the cutting tool comprises an assembly of at least two fluid discharge bodies distributed around the cutting section, whereby each fluid discharge body is structured in a manner allowing each fluid discharge body to form a corresponding hole through the pipe wall of the pipe body.

19. The hydraulic cutting tool according to claim 18, wherein at least one cutting section comprises an assembly of several fluid discharge bodies distributed in a predetermined pattern around the cutting section, wherein the several fluid discharge bodies are structured in a manner allowing them to form a corresponding predetermined pattern of holes through the pipe wall of the pipe body.

20. The hydraulic cutting tool according to claim 1, wherein the mandrel comprises at least two cutting sections disposed successively along the mandrel.

21. The hydraulic cutting tool according to claim 20, wherein a flow-isolating means is disposed between neighbouring cutting sections along the mandrel, wherein the flow-isolating means is structured for selective activation and closing of the flow channel between such neighbouring cutting sections, which allows for individual activation of successive cutting sections along the mandrel.

22. The hydraulic cutting tool according to claim 21, wherein the flow-isolating means comprises a ring-shaped receiving seat forming a through opening, the receiving seat of which is disposed around the internal flow channel in the mandrel; and wherein the ring-shaped receiving seat is structured for selective sealing reception of a separate plug body.

23. The hydraulic cutting tool according to claim 1, wherein at least one anchoring section in the cutting tool comprises an assembly of at least two radially movable gripping elements distributed around the at least one anchoring section.

24. The hydraulic cutting tool according to claim 23, wherein the at least two radially movable gripping elements are aligned along a common circumferential line around the at least one anchoring section.

25. The hydraulic cutting tool according to claim 1, wherein at least one anchoring section in the cutting tool comprises the at least one radially movable gripping element in the form of a flexible and expandable gripping body enclosing such an anchoring section.

26. The hydraulic cutting tool according to claim 24, wherein the at least one anchoring section is disposed in proximity of the at least one cutting section, whereby the anchoring section and the cutting section form an assembly thereof.

27. The hydraulic cutting tool according to claim 25, wherein the at least one anchoring section is disposed in proximity of the at least one cutting section, whereby the anchoring section and the cutting section form an assembly thereof.

28. The hydraulic cutting tool according to claim 1, wherein at least one anchoring section in the cutting tool is disposed between the at least one cutting section and the first end of the mandrel.

29. The hydraulic cutting tool according to claim 1, wherein at least one anchoring section in the cutting tool is disposed between the at least one cutting section and the second end of the mandrel.

30. A system for controlled hydraulic cutting through a pipe wall, wherein the system comprises the following combination of features:

a well;

a first pipe body disposed in the well and comprising said pipe wall;

a second pipe body disposed in the well and located outside and around the first pipe body;

a pipe string disposed within the first pipe body; and an abrasive fluid source connected in a flow communicating manner to an upper portion of the pipe string, wherein the system also comprises a hydraulic cutting tool comprising a mandrel having the following combination of features:

a first end;

a second end structured in a manner allowing the second end to be connected to a flow-through pipe string for selective remote supply of an abrasive fluid;

an internal flow channel connected in a flow communicating manner to at least said second end;

at least one anchoring section provided each with at least one radially moveable gripping element structured for selective activation and anchoring against an inside of the first pipe body; and at least one cutting section provided each with outwardly directed discharge opeanings connected in a flow communicating manner to said internal flow channel for supply of said abrasive fluid, wherein each discharge opening is configured in a manner allowing each discharge opening to form a discharging cutting jet of the abrasive fluid for cutting through the pipe wall, wherein the at least one cutting section also comprises at least one fluid discharge body;

wherein each such fluid discharge body comprises at least two outwardly directed discharge openings having non-parallel discharging directions directed at a common intersection point located outside the fluid discharge body; and wherein said outwardly directed discharge openings are connected in a flow communicating manner to the internal flow channel in the mandrel;

whereby abrasive cutting jets, which discharge at high velocity from said discharge openings in each fluid discharge body, are structured in a manner allowing them to cut into and through the pipe wall of the first pipe body, thus forming at least one hole through the pipe wall; and whereby said abrasive cutting jets also are structured in a manner allowing them to meet and disperse in said intersection point, thus weakening the further cutting ability of the cutting jets;

wherein the hydraulic cutting tool is connected to a lower portion of the pipe string for formation of at least one hole through the pipe wall of the pipe body; and wherein said common intersection point for the non-parallel discharge directions from the at least one fluid discharge body in the cutting to is located, when in a cutting position, some place between a minimum distance and a maximum distance, as measured in the radial direction from the outwardly directed discharge openings in each such fluid discharge body, wherein said minimum distance is defined by a midpoint between said discharge openings and an inside of the first pipe body, and wherein said maximum distance is defined by a midpoint between an outside of the first pipe body and an inside of the second pipe body;

whereby the system is structured for selective remote supply of the abrasive fluid from said abrasive fluid source and onto the hydraulic cutting tool;

whereby the system also is structured in a manner allowing the system to form the abrasive cutting jets disharging at high velocity from said discharge openings in each fluid discharge body and cutting into and through the pipe wall of the first pipe body, thus forming at least one hole through this pipe wall; and whereby the system also is structured in a manner allowing the system to form the abrasive cutting jets meeting and dispersing in said intersection point, thus weakening the further cutting ability of the cutting jets on the second pipe body after formation of said hole through the pipe wall of the first pipe body.

31. The system according to claim 30, wherein a minimal radial distance between the outside of the first pipe body and the inside of the second pipe body is determined by a radial thickness of a pipe collar for the first pipe body.

32. The system according to claim 30, wherein said common intersection point is located some place between said minimum distance and the outside of the first pipe body.

33. The system according to claim 32, wherein the common intersection point is located some place between said minimum distance and the inside of the first pipe body.

34. The system according to claim 32, wherein the common intersection point is located some place in the pipe wall of the first pipe body.

35. The system according to claim 30, wherein said common intersection point is located some place between the outside of the first pipe body and said maximum distance.

36. The system according to claim 31, wherein said common intersection point is located some place between the outside of the first pipe body and said maximum distance.

37. A method for controlled hydraulic cutting through a pipe wall of a first pipe body in a well, and from internally in the first pipe body, and without cutting through a pipe wall of a second pipe body located outside and around the first pipe body in the well, wherein the method comprises the following combination of steps:

(A) using a hydraulic cutting tool comprising a mandrel having the following combination of features:

a first end;

a second end structured in a manner allowing the second end to be connected to a flow-through pipe string for selective remote supply of an abrasive fluid;

an internal flow channel connected in a flow communicating manner to at least said second end;

at least one anchoring section provided each with at least one radially moveable gripping element structured for selective activation and anchoring against an inside of the first pipe body; and at least one cutting section provided each with outwardly directed discharge openings connected in a flow communicating manner to said internal flow channel for supply of said abrasive fluid, wherein each discharging opening is configured in a manner allowing each flow discharge opening to form a discharge cutting jet of the abrasive fluid for cutting through the pipe wall of the first pipe body, wherein the at least one cutting section also comprises at least one fluid discharge body;

wherein each such fluid discharge body comprises at least two outwardly directed discharge openings having non-parallel discharge directions directed at a common intersection point located outside the fluid discharge body; and wherein said outwardly directed discharge openings are connected in a flow communicating manner to the internal flow channel in the mandrel;

whereby the abrasive cutting jets, which discharge at high velocity from said discharge openings in each fluid discharge body, are structured in a manner allowing them to cut into and through the pipe wall of the first pipe body, thus forming at least one hole through the first pipe wall; and whereby said abrasive cutting jets also are structured in a manner allowing them to meet and disperse in said intersection point, thus weakening the further cutting ability of the cutting jets.

(B) connecting the second end of the mandrel of the cutting tool, and thus the cutting tool, to a lower portion of the flow through pipe string;

(C) lowering the pipe string and the connected cutting tool into the first pipe body until the cutting tool is located at a longitudinal section of the well where the at least one hole is to be formed through the pipe wall of the first pipe body;

(D) selectively activating the at least one gripping element in the anchoring section of the cutting tool so as to move said gripping element radially outwards until engagement with an inside of the first pipe body, thereby anchoring the cutting tool in the first pipe body;

(E) disposing the outwardly directed discharge openings in the at least one fluid discharge body in the at least one cutting section of the cutting tool at a predetermined distance from the inside of the first pipe body, wherein the predetermined distance is selected such that said common intersection point for the non-parallel discharge directions from said fluid discharge body is located, when in a cutting position, some place between a minimum distance and a maximum distance, as measured in the radial direction from the outwardly directed discharge openings in each such fluid discharge body, wherein said minimum distance is defined by a midpoint between said discharge openings and the inside of the first pipe body, and wherein said maximum distance is defined by a midpoint between an outside of the first pipe body and an inside of the second pipe body;

(F) selectively pumping, from an abrasive fluid source connected in a flow communicating manner to an upper portion of the pipe string, the abrasive fluid down through the pipe string and the mandrel of the cutting tool in order to discharge the abrasive cutting jets from said discharge openings in said fluid discharge body in at least one cutting section in the cutting tool;

whereby said abrasive cutting jets, which discharge at high velocity from said discharge openings in each fluid discharge body, cut into and through the pipe wall of the first pipe body, thus forming the at least one hole through the pipe wall; and whereby the abrasive cutting jets also meet and disperse in said intersection point, thus weakening the further cutting ability of the cutting jets on the second pipe body after formation of said hole through the pipe wall of the first pipe body;

(G) terminating the pumping of the abrasive fluid after a predetermined period of time corresponding to, as a minimum, the time required to cut the at least one hole through the pipe wall of the first pipe body at the existing conditions in the well; and (H) selectively deactivating the at least one gripping element so as to move said gripping element radially inwards from the first pipe body, thereby releasing the cutting tool from engagement with the first pipe body.

38. The method according to claim 37, wherein the method comprises, in step (G), determining the predetermined period of time via at least one prior test reflecting the existing conditions in the well.

39. The method according to claim 37, comprising determining a minimum radial distance between the outside of the first pipe body and the inside of the second pipe body by a radial thickness of a pipe collar of the first pipe body.

40. The method according to claim 37, wherein said common intersection point is located some place between said minimum distance and the outside of the first pipe body.

41. The method according to claim 40, wherein the common intersection point is located some place between said minimum distance and the inside of the first pipe body.

42. The method according to claim 40, wherein the common intersection point is located some place in the pipe wall of the first pipe body.

43. The method according to claim 37, wherein said common intersection point is located some place between the outside of the first pipe body and said maximum distance.

44. The method according to claim 37, wherein the at least one fluid discharge body is structured so as to be stationary.

45. The method according to claim 37, wherein the at least one fluid discharge body is structured so as to be radially movable; and wherein the method comprises, in step (E), selectively moving the fluid discharge body until being positioned at said predetermined radial distance from the first pipe body.

46. The method according to claim 37, wherein at least one cutting section in the cutting tool comprises an assembly of at least two fluid discharge bodies distributed around the cutting section, thereby forming, in steps (F) and (G) of the method, at least two corresponding holes through the pipe wall of the first pipe body.

47. The method according to claim 46, wherein at least one cutting section comprises an assembly of several fluid discharge bodies distributed in a predetermined pattern around the cutting section, thereby forming, in steps (F) and (G) of the method, a corresponding pattern of holes through the pipe wall of the first pipe body.

48. The method according to claim 37, wherein the mandrel comprises at least two cutting sections disposed successively along the mandrel;

wherein a flow-isolating means is disposed between neighbouring cutting sections along the mandrel; and wherein the method comprises, before step (F), selectively activating and closing off said flow channel between such neighbouring cutting sections by means of the associated flow-isolating means, which allows for individual activation of successive cutting sections along the mandrel.

49. The method according to claim 37, wherein the abrasive fluid comprises drilling mud admixed with abrasive particles, and wherein the pipe walls of the first pipe body and the second pipe body are comprised of steel; and wherein the method comprises, in step (F), pumping the abrasive fluid at a flow rate providing the abrasive cutting jets, which are discharging from said discharge openings in the at least one fluid discharge body, with a discharge velocity in the order of 90-140 m/s.

50. The method according to claim 49, comprising pumping the abrasive fluid at a flow rate providing the abrasive cutting jets with a flow velocity being less than 75 m/s after collision of the cutting jets in said common intersection point.

51. The method according to claim 50, wherein said flow velocity is in the order of 55-75 m/s.

52. The method according to claim 37, wherein the method also comprises, after step (H), the following steps:

(I) pumping a washing fluid down into the first pipe body onto said longitudinal section of the well where the at least one hole has been formed through the pipe wall of the first pipe body; and (J) washing, by means of the washing fluid, the first pipe body, hence also an annulus located between the first pipe body and the second pipe body via the at least one hole, within at least said longitudinal section of the well, thereby cleaning both the first pipe body and said annulus along at least said longitudinal section of the well.

53. The method according to claim 37, wherein the method also comprises, after step (H), the following steps:

(K) pumping a fluidized plugging material down into the first pipe body onto said longitudinal section of the well where the at least one hole has been formed through the pipe wall of the first pipe body; and (L) placing the fluidized plugging material in the first pipe body, hence also in an annulus located between the first pipe body and the second pipe body via the at least one hole, within at least said longitudinal section of the well, thereby plugging both the first pipe body and said annulus along at least said longitudinal section of the well.

54. The method according to claim 52, wherein the method also comprises, after step (H), the following steps:

(K) pumping a fluidized plugging material down into the first pipe body onto said longitudinal section of the well where the at least one hole has been formed through the pipe wall of the first pipe body; and (L) placing the fluidized plugging material in the first pipe body, hence also in an annulus located between the first pipe body and the second pipe body via the at least one hole, within at least said longitudinal section of the well, thereby plugging both the first pipe body and said annulus along at least said longitudinal section of the well.

* * * * *